US006003917A

United States Patent [19]

Tygard

[11] Patent Number: 6,003,917

[45] Date of Patent: Dec. 21, 1999

[54] CLAMPING APPARATUS

[75] Inventor: Edward Tygard, McMurray, Pa.

[73] Assignee: Tygard Machine and Manufacturing Co., Washington, Pa.

[21] Appl. No.: 08/889,362

[22] Filed: Jul. 8, 1997

Related U.S. Application Data

[60] Provisional application No. 60/021,554, Jul. 11, 1996.

[51] Int. Cl.[6] ..... B66F 9/18

[52] U.S. Cl. ..... 294/87.1; 294/95; 294/113; 294/902; 414/607; 414/623

[58] Field of Search ..... 294/2, 62, 63.1, 294/81.51, 81.61, 81.62, 87.1, 93–97, 99.1, 106, 110.1, 113, 119.1, 902; 414/607, 608, 621–623, 626, 627, 739, 790.2, 791.8, 791.9, 792.9, 796.9

[56] References Cited

U.S. PATENT DOCUMENTS

| | | | |
|---|---|---|---|
| 1,466,524 | 8/1923 | Folland et al. . | |
| 1,807,124 | 5/1931 | Meyer | 294/119.1 X |
| 2,170,706 | 8/1939 | Callaghan | 294/63.1 |
| 2,696,317 | 12/1954 | Toffolon . | |
| 2,699,879 | 1/1955 | Bertram . | |
| 2,761,579 | 9/1956 | Bickerstaff . | |
| 2,807,493 | 9/1957 | Ryan et al. | 294/90 |
| 2,896,994 | 7/1959 | Fischer | 294/63.1 |
| 2,924,484 | 2/1960 | Tolsma | 294/87.1 |
| 3,020,078 | 2/1962 | Ray | 294/63.1 |
| 3,030,138 | 4/1962 | Bennett | 294/63.1 |
| 3,055,521 | 9/1962 | Crampton . | |
| 3,194,422 | 7/1965 | Shinn, Jr. . | |
| 3,212,808 | 10/1965 | Breslav et al. . | |
| 3,237,980 | 3/1966 | Helms . | |
| 3,262,595 | 7/1966 | Seip, Jr. et al. . | |
| 3,270,897 | 9/1966 | Lingl . | |
| 3,339,966 | 9/1967 | Carlson . | |
| 3,637,250 | 1/1972 | Blonsky | 294/88 |
| 3,675,961 | 7/1972 | Wheeler . | |
| 3,718,228 | 2/1973 | Lund et al. . | |
| 3,854,616 | 12/1974 | Willis et al. . | |
| 3,971,485 | 7/1976 | Hoppey . | |
| 3,984,020 | 10/1976 | Fuller et al. . | |
| 3,987,905 | 10/1976 | Dechantsreiter . | |
| 4,005,895 | 2/1977 | Cullings | 294/65.5 |
| 4,252,496 | 2/1981 | Williams | 414/623 |
| 4,331,320 | 5/1982 | Naruse et al. . | |
| 4,355,936 | 10/1982 | Thomas et al. | 414/118 |
| 4,556,359 | 12/1985 | Sinclair | 294/119.1 X |
| 4,603,896 | 8/1986 | Vasseur et al. | 294/2 |
| 4,636,131 | 1/1987 | Sinclair | 414/621 |
| 4,714,399 | 12/1987 | Olson | 414/621 |
| 4,911,605 | 3/1990 | Berg | 414/623 |
| 5,088,878 | 2/1992 | Focke et al. | 414/627 |
| 5,141,274 | 8/1992 | Hayden et al. | 294/2 |
| 5,161,934 | 11/1992 | Richardson | 414/621 |
| 5,253,974 | 10/1993 | Williams | 414/623 |
| 5,516,255 | 5/1996 | Tygard | 414/607 |

FOREIGN PATENT DOCUMENTS

| | | | |
|---|---|---|---|
| 277129 | 12/1964 | Australia . | |
| 0482406 | 4/1992 | European Pat. Off. . | |
| 1201523 | 9/1965 | Germany | 294/63.1 |
| 3032805 | 6/1982 | Germany | 294/63.1 |
| 1546406 | 2/1990 | U.S.S.R. . | |
| 1555259 | 4/1990 | U.S.S.R. . | |

*Primary Examiner*—Johnny D. Cherry
*Attorney, Agent, or Firm*—Leydig, Voit & Mayer, Ltd.

[57] ABSTRACT

A clamping apparatus for lifting objects includes a frame and two or more clamping arms pivotably supported by the frame for movement into and out of contact with an object to be lifted. An internal support is supported by the frame for reinforcing the inner walls of a cavity in the object to be lifted. The insert may be supported by the frame for vertical movement with respect to the frame so that when the insert is not needed, it can be raised above the object. The insert may passively reinforce a cavity, or it may be equipped with movable reinforcing portions which can be moved into and out of contact with the walls of the cavity which is to be reinforced.

36 Claims, 17 Drawing Sheets

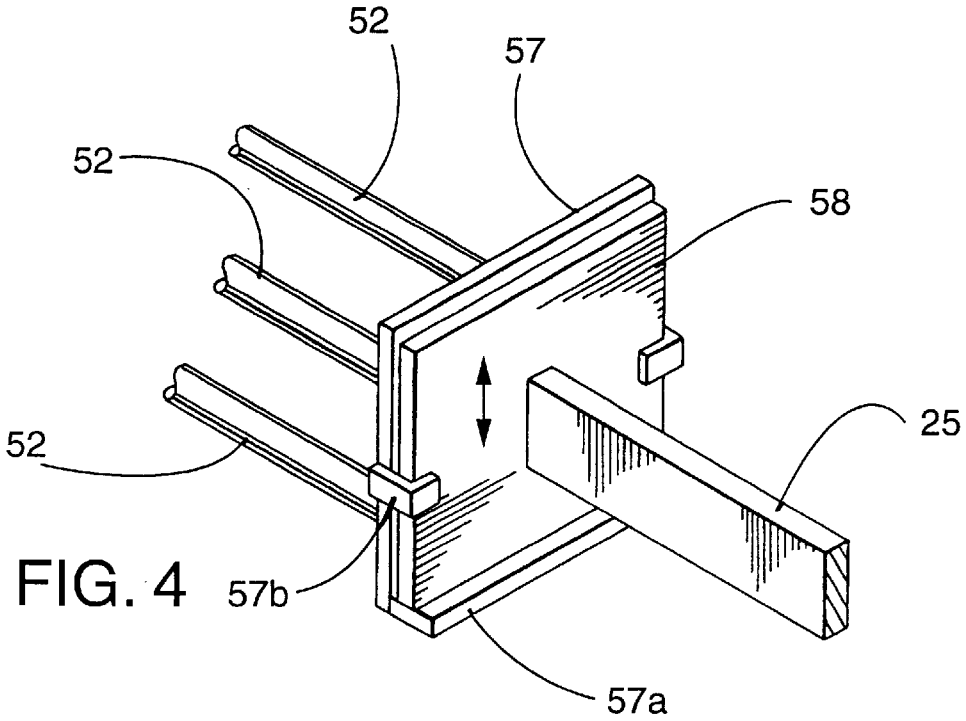
FIG. 4
FIG. 5
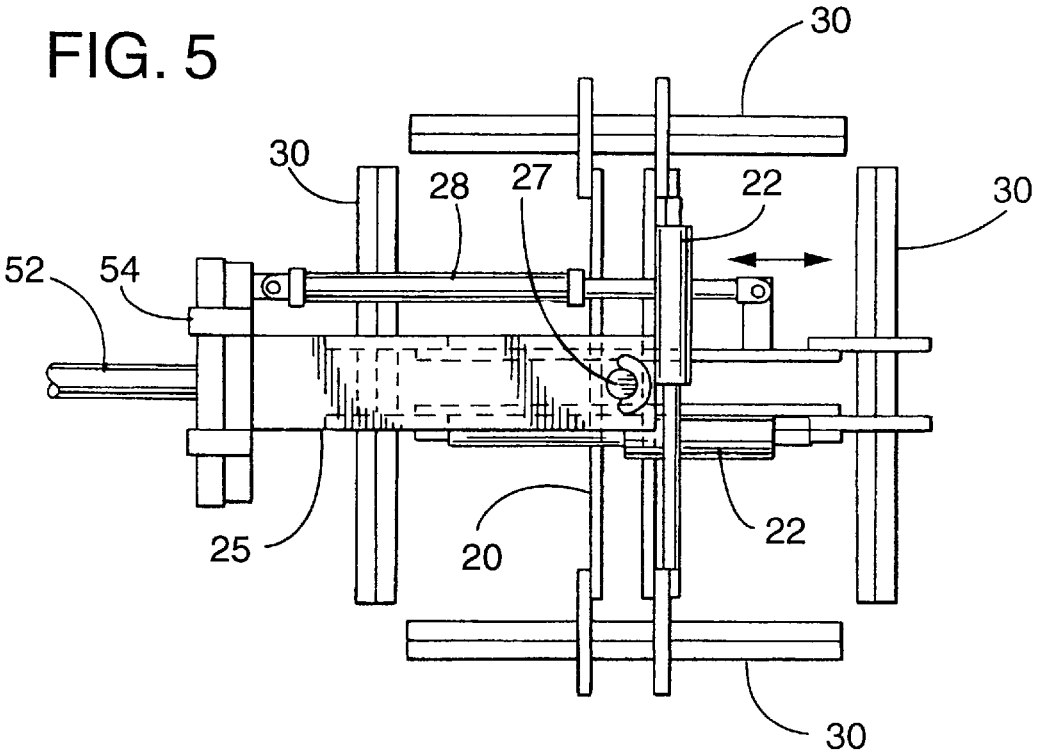

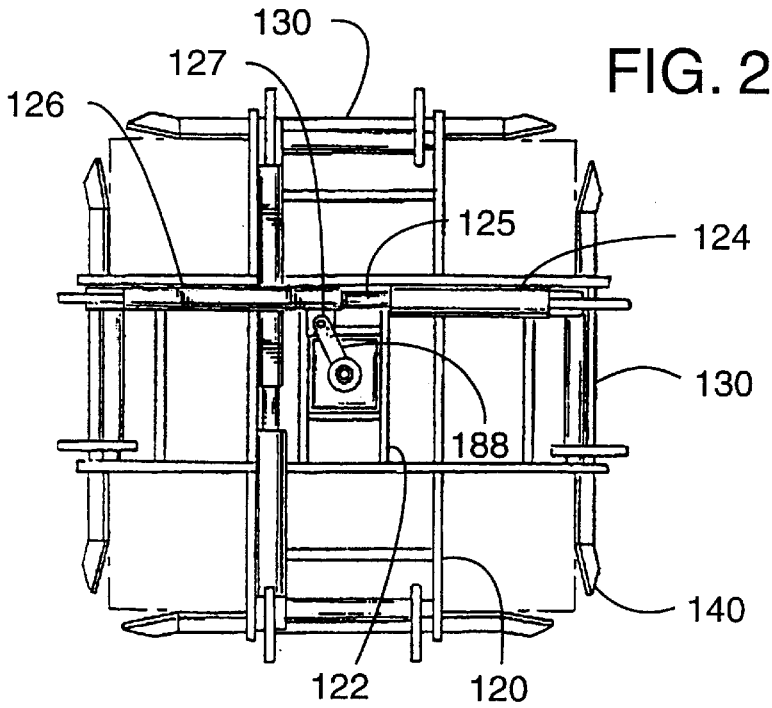
FIG. 20
FIG. 21
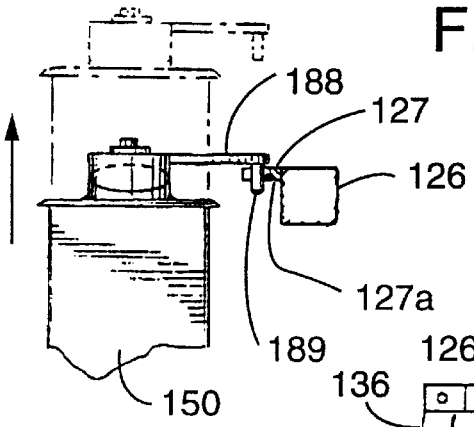
FIG. 22
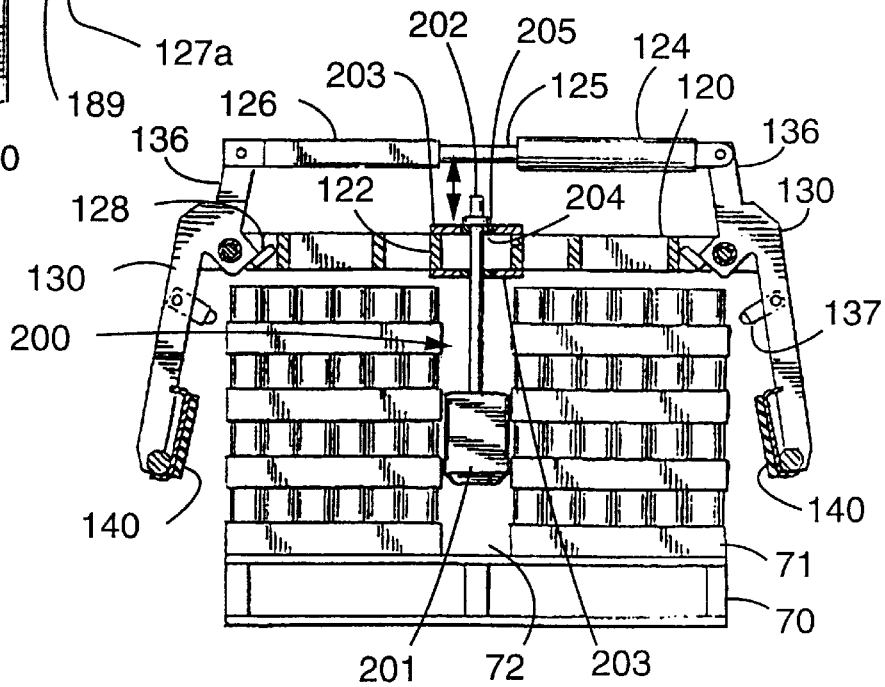

CLAMPING APPARATUS

REFERENCE TO RELATED APPLICATIONS

This application claims the benefit of U.S. Provisional Application Ser. No. 60/021,554 filed on Jul. 11, 1996.

BACKGROUND OF THE INVENTION

1. Industrial Field of Use

This invention relates to a clamping apparatus for use in lifting objects such as cases of soft drink cans or bottles. More particularly, it relates to a clamping apparatus capable of lifting an entire layer of objects by grasping the sides of the layer.

2. Description of the Related Art

Soft drink cans and bottles are commonly shipped from factories in cases or trays stacked on pallets, which can be lifted with a fork lift. Each pallet supports one or more layers of the cases or trays. Typically, a pallet as shipped from a bottling factory contains a single type of product. However, retailers of soft drinks frequently order less than an entire pallet of a particular type of soft drink. For example, a retailer may desire a half pallet of orange soda, a quarter pallet of grape soda, and a quarter pallet of ginger ale. Therefore, before soft drinks are shipped to a retailer, they may be unloaded by a distributor from pallets containing a single variety and repacked as pallets containing more than one variety of soft drinks.

The process of unloading and reloading pallets of soft drink cases is usually done by hand. This is monotonous and arduous work, and often results in physical injuries to the laborers who do this work. Furthermore, manual transfer of cases between pallets is a slow process, and a typical worker can unload and reload no more than 500 cases of soft drink cans per hour. This same problem exists with many other types of products, such as alcoholic beverages and grocery products, which are shipped from factories in lots too large for a single retailer to use and so are unloaded and reloaded by hand by a distributor to obtain pallets containing a suitable number of goods for shipment to a retailer.

Clamping devices have been developed which can lift one or more entire layers of objects (such as bricks) at a time from a pallet and move the layers to a different pallet. These devices typically have four clamping arms which pivot about horizontal axes to clamp the outer surface of a layer from four directions at once. The clamping arms, with the layer of bricks or other objects held between them, can then be transferred to a new location by a fork lift, a crane, or other lifting mechanism. However, these conventional clamping devices are all designed for lifting layers having specific fixed dimensions and are not suitable for lifting layers of variable dimensions. For example, if a clamping device designed for lifting a perfectly square layer is used to lift an elongated rectangular layer, two of the clamping arms will grasp the layer at a different height from the other two clamping arms.

With some objects, this difference in height may not be a problem. However, with cases of soft drinks, for example, a difference of a few inches between the heights where the clamping arms contact the different sides of the layer can make it impossible for the clamping arms to lift the layer. Accordingly, there is a need for a clamping apparatus which can be used to lift both square objects and elongated rectangular objects while holding all four sides of the objects at substantially the same height.

Sometimes, a layer of objects which is to be lifted contains a cavity at its center. There is also need for a clamping apparatus which can lift such a layer without damage to the objects in the layer.

SUMMARY OF THE INVENTION

It is an object of the present invention to provide a clamping apparatus for containers which can handle objects of various shapes, including both square and elongated rectangular objects.

It is another object of the present invention to provide a clamping apparatus which can perform loading and unloading of pallets at a far higher speed than is possible by hand.

It is yet another object of the present invention to provide a clamping apparatus which can lift a layer of objects containing a cavity.

It is a further object of the present invention to provide a method of lifting a layer of objects containing a cavity.

A clamping apparatus according to one form of the present invention includes a frame and a plurality of clamping arms each having a contact portion for contacting a layer of objects to be lifted. The clamping arms are supported by the frame for movement with respect to the frame between first and second positions, a separation between the contact portions being greater in the first position than in the second position. An internal support for insertion into a cavity in a layer of objects to be contacted by the contact portions of the clamping arms is supported by the frame between the clamping arms for movement with respect to the frame between a raised and a lowered position. In its lowered position, the internal support can reinforce the inner walls of a cavity in a layer of objects to be lifted and can preventing shifting of and damage to the objects adjoining the cavity. When the clamping apparatus is used to lift a layer of objects without a cavity, the internal support can be moved to its raised position so as not to interfere with the operation of the clamping arms.

The internal support may be a member having an outer surface with constant dimensions which passively reinforces the inner walls of a cavity, or it may be equipped with movable reinforcing members which can be moved from a retracted position into an extended position in which the reinforcing members reinforce the inner walls of a cavity. In a preferred embodiment, the reinforcing members comprise paddles which are pivotably mounted on the internal support.

The clamping arms can move between their first and second positions by any type of motion, such as by translation, rotation, or a combination of translation and rotation. In preferred embodiments, the clamping arms are pivotably mounted on the frame.

A clamping apparatus according to the present invention is particularly suitable for use with a fork lift. However, it can be used with any mechanism capable of raising and lowering the clamping apparatus together with a load held by the clamping apparatus, such as a crane, a boom, a davit, or a robot arm.

A clamping apparatus according to the present invention is particularly suited for lifting rectangular cases or trays of soft drink cans arranged in square or elongated rectangular layers. However, the present invention is not restricted to use with any particular type or shape of object, and it can be used to lift bricks, lumber, barrels, bottles, and other cylindrical objects, bales, stacks of paper products, and boxes, cartons, and packages of various types of merchandise, to give but a few examples. The object or objects to be lifted need not be arranged in layers, and the apparatus can be used to lift a single object, such as a single box. Thus, the present invention can be used with virtually any objects which can be grasped by forces applied from a plurality of sides.

BRIEF DESCRIPTION OF THE DRAWINGS

FIG. 4 is a perspective view of another example of a joint for connecting the clamping portion to the side travel portion.

FIG. 5 is a plan view of an embodiment in which the frame of the clamping portion can pivot about a vertical axis.

FIGS. 19 and 20 are plan views of another embodiment of the present invention in which the internal support is coupled to the hydraulic cylinder for one of the clamping arms.

FIG. 21 is an elevation of a portion of the embodiment of FIGS. 19 and 20 illustrating how a lever of the internal support is releasably coupled to one of the hydraulic cylinders.

FIG. 22 is a vertical cross-sectional view of another embodiment of the present invention.

DESCRIPTION OF PREFERRED EMBODIMENTS

Figure 1:
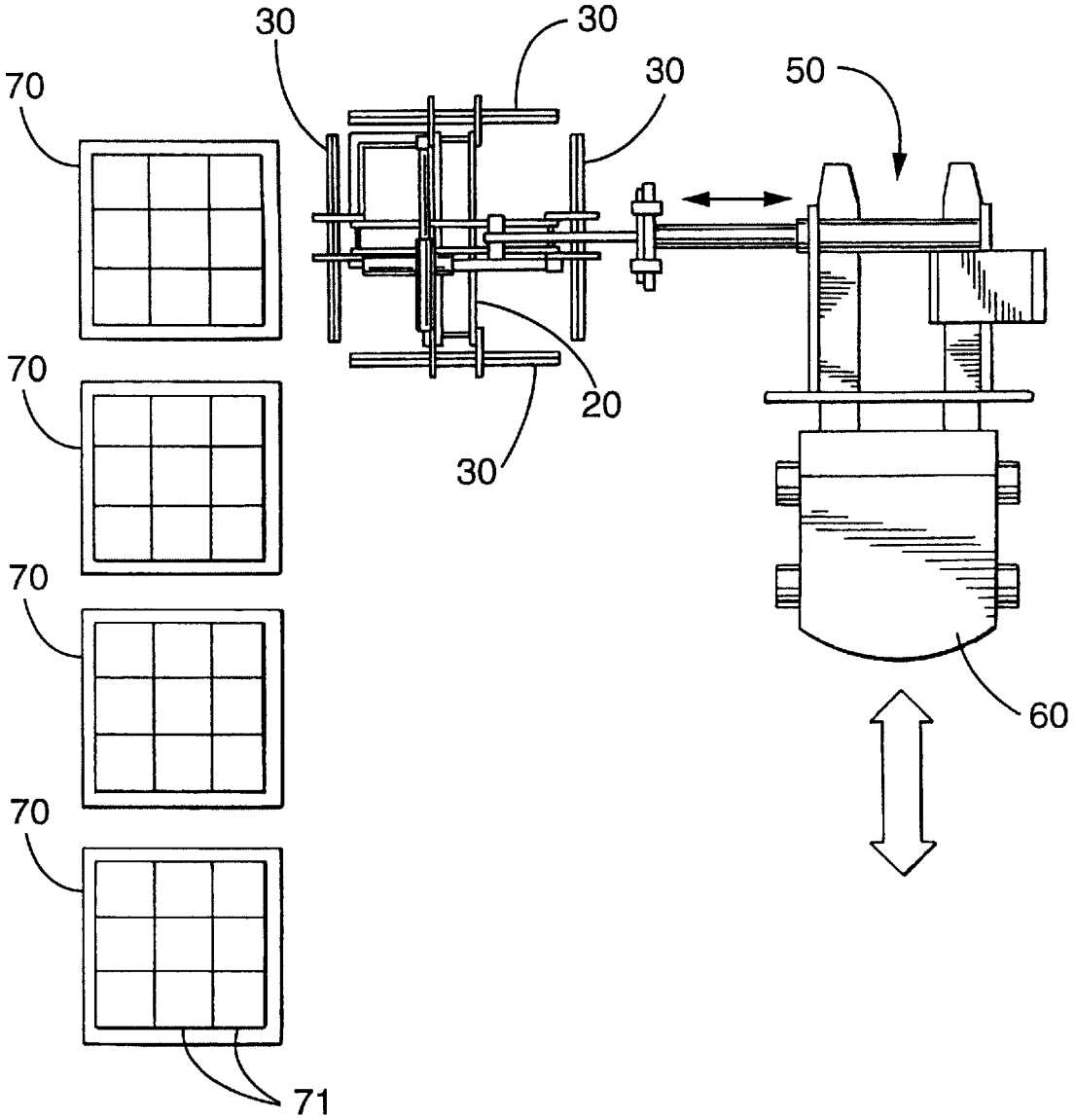
FIG. 1 is a plan view of an embodiment of a clamping apparatus according to the present invention.
Figure 2:
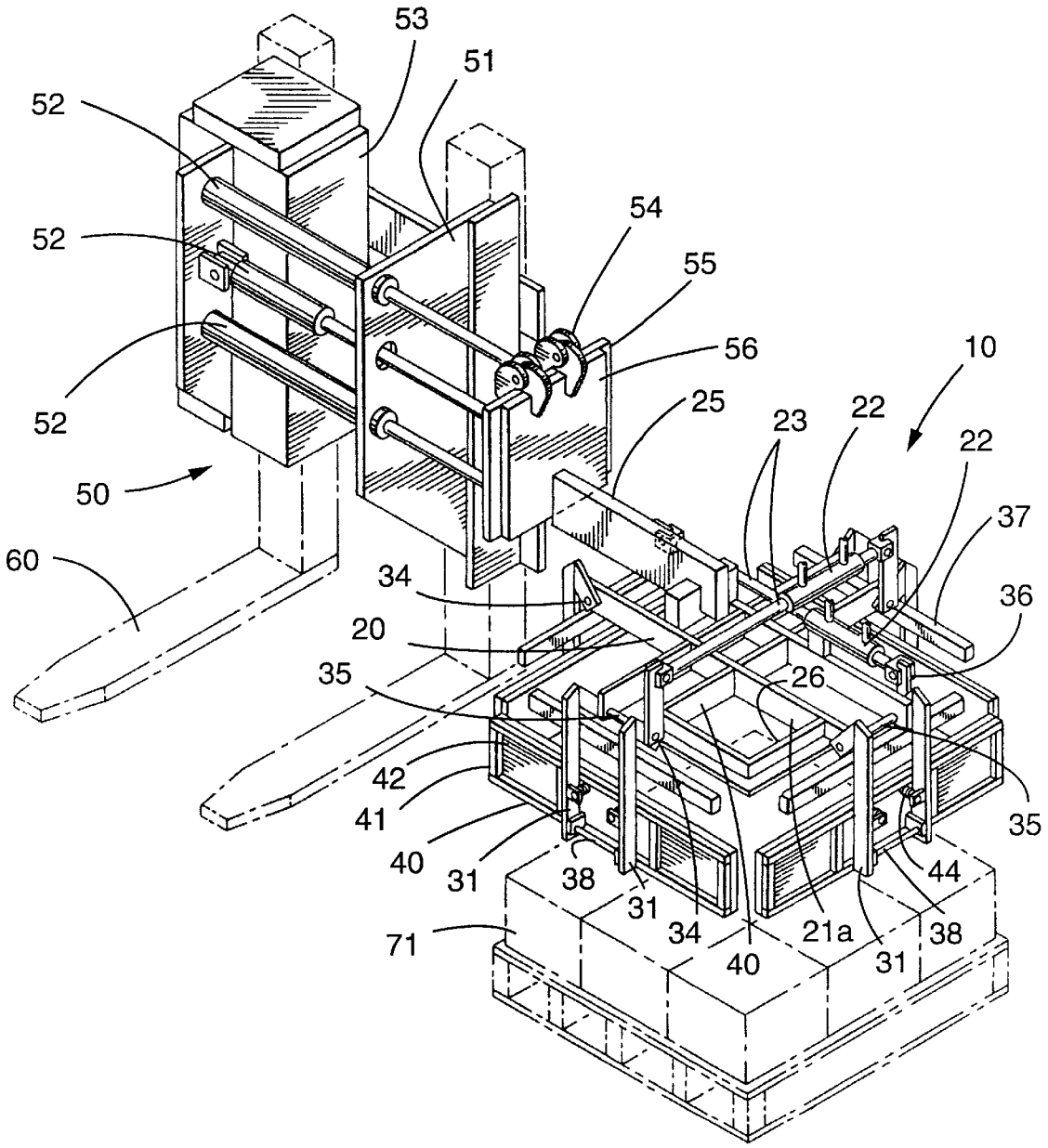
FIG. 2 is a perspective view of the embodiment of FIG. 1.

FIGS. 1–3 illustrate a first embodiment of a clamping apparatus according to the present invention. This embodiment will be described as used in handling cases of soft drink cans stacked in layers on pallets, but as stated above, the apparatus can be used with a wide variety of objects.

As shown in these figures, this embodiment of a clamping apparatus includes a clamping portion 10 capable of grasping one or more layers of cases 71 of soft drink cans stacked on pallets 70, and a side shifter 50 which movably supports the clamping portion 10 on a fork lift 60. The side shifter 50 can move the clamping portion 10 in the lateral direction of the fork lift 60, which is to the left and right in FIG. 1.

The clamping portion 10 has a rigid frame 20 which pivotably supports four clamping arms 30 so as to define a four-sided space. The shape of the frame 20 is arbitrary, and in this embodiment it has the shape of a cross. The frame 20 is formed from a first pair of parallel plates 21*a* and a second pair of parallel plates 21*b* which crosses the first pair at 90-degree angles and is rigidly secured to the first pair where the pairs intersect. Two of the clamping arms 30 are pivotably mounted in opposing relationship on the opposite ends of the first pair of plates 21*a* for pivoting about parallel horizontal axes, and the other two clamping arms 30 are pivotably mounted in opposing relationship on the opposite ends of the second pair of plates 21*b* for pivoting about parallel horizontal axes extending perpendicular to the axes of pivoting of the other two clamping arms 30.

Figure 3A:
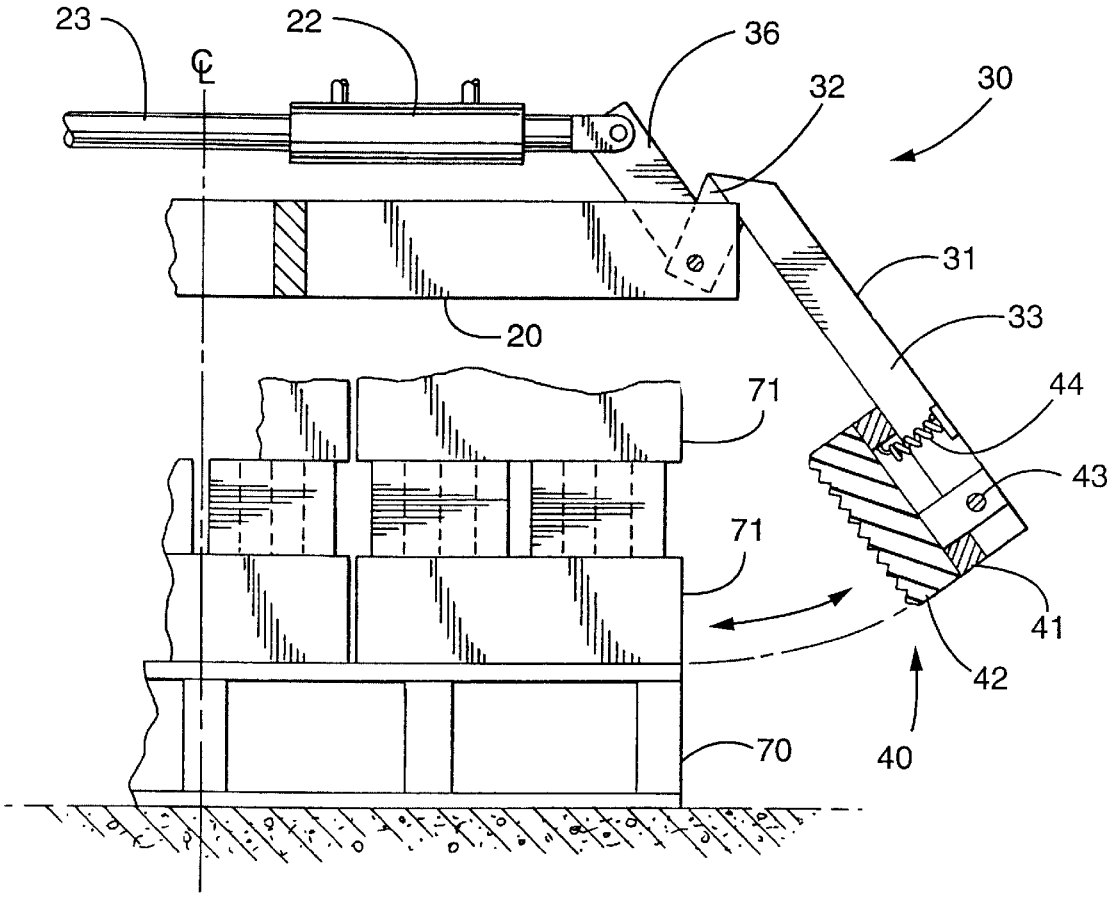
FIGS. 3A–3C are side elevations of one of the clamping arms of the embodiment of FIG. 1 at different angular positions.
Figure 3B:
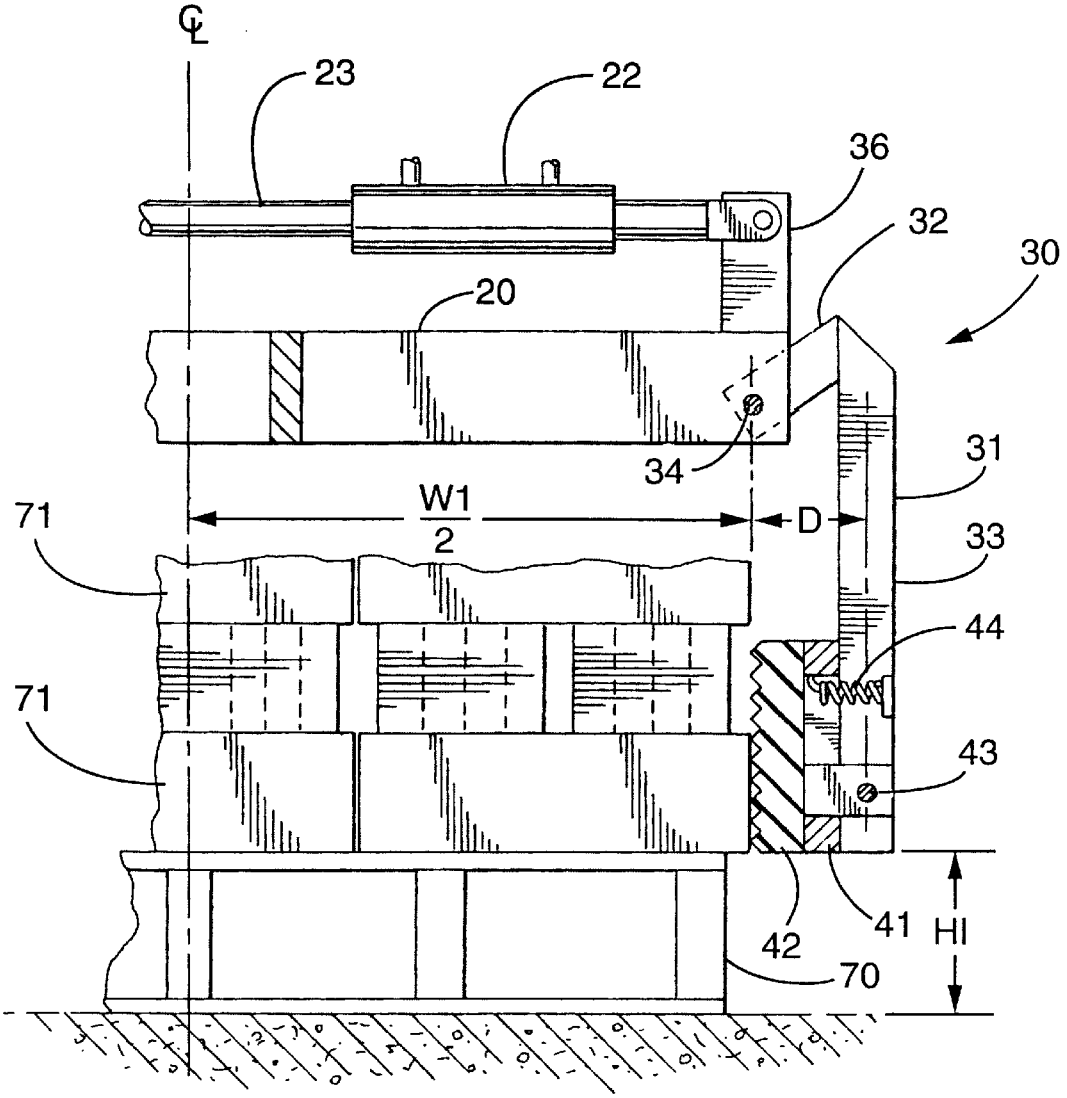
Figure 3C:
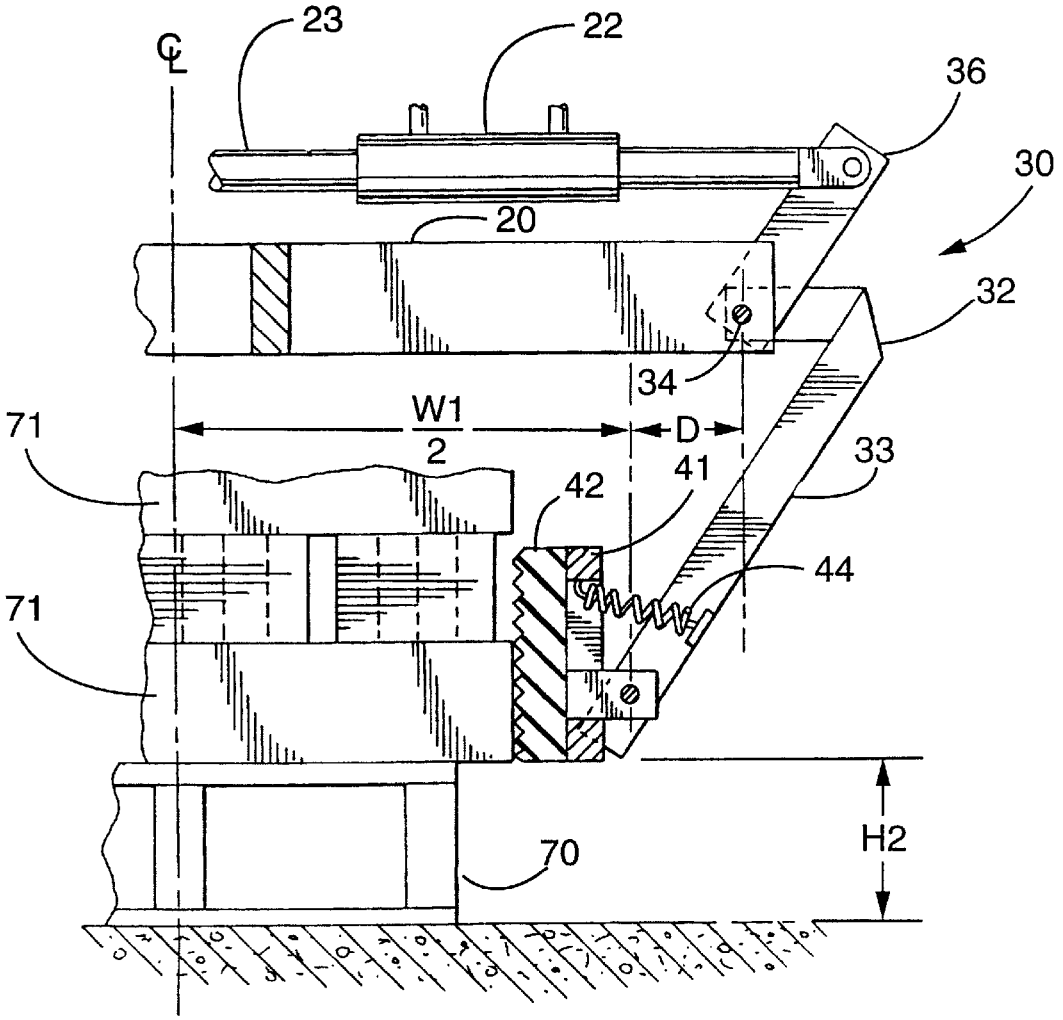

The four clamping arms 30 need not be identical, but in the present embodiment they all have the same structure and substantially the same dimensions. As best shown in FIGS. 3A–3C, each clamping arm 30 has a pair of support arms 31 pivotably secured to an end of the frame 20 at a pivot point 34, and a contact portion in the form of a panel 40 supported by the lower end of the support arm 31 for contacting a layer of objects to be lifted. Each support arm 31 has a first section 32 pivotably connected to the frame 20 at one of the pivot points 34, and a second section 33 secured to and extending downward from the first section 32. The support arms 31 can be pivotably supported by the frame 20 in any suitable manner. In this embodiment, a shaft 35 is secured to the first sections 32 of each pair of support arms and is rotatably supported by holes in the plates 21*a*, 21*b* of the frame 20 at one of the pivot points 34. Alternatively, the shaft 35 can be secured to the frame 20 and the support arms 31 can be pivotably mounted on the shaft 35. A lever arm 36 extends upwards from the first section 32 of one of the support arms 31 of each pair and is rigidly secured to the first section 32 so that the lever arm 36 and the support arm 30 to which it is connected pivot together about the corresponding pivot point 34.

The first and second sections 32 and 33 of each support arm 31 may be separate members which are rigidly secured to each other, or they may be formed as a single member. The support arms 31 have been found to function particularly well when the two sections 32 and 33 form an acute angle where they intersect. Preferably, the angle is in the range of approximately 15 to approximately 80 degrees, and more preferably in the range of approximately 30 to approximately 60 degrees. For example, in the illustrated preferred embodiment, the angle between the first and second sections 32 and 33 of each support arm 31 is approximately 57 degrees. Therefore, when the second section 33 of a support arm 31 is vertical, the first section 32 extends diagonally upwards from pivot point 34 at an angle of approximately 57 degrees from the vertical. However, other shapes for the support arms 31 are possible. For example, the two sections 32 and 33 may define a right angle or obtuse angle. Alternatively, each support arm 31 may have the shape of an arc extending outwards from the corresponding pivot point 34.

The individual cases 71 of soft drink cans are generally rectangular, and are stacked on pallets 70 in layers which are either squares or elongated rectangles. The four panels 40 of the clamping arms 30 are used to grasp a layer of cases 71 from four sides at once. In some applications, it is preferable if the panels 40 are pivotable with respect to the support arms 31 about horizontal axes so that the opposing surfaces of the panels 40 can be maintained substantially vertical, even when the second sections 33 of the support arms 31 are sloped with respect to the vertical. Each panel 40 includes a rigid rectangular frame 41 and a resilient pad 42 of rubber or similar material mounted on the frame 41. To increase the gripping ability of the pad 42, its surface may be serrated or otherwise roughened. Preferably, the vertical dimension (the height) of each pad 42 is somewhat greater than the height of a layer of objects to be lifted so that when a plurality of layers are being lifted, the pads 42 will contact the more than one layer and the force exerted by the pads 42 can be distributed between the layers, thereby decreasing the pressure applied to a single layer. If each layer contains cans of soft drinks measuring approximately 5 inches tall, an example of a suitable height for each pad 42 is on the order of 6.5 inches. Each frame 41 is pivotably mounted about a pivot point 43 on a shaft 38 extending between the lower ends of the second sections 33 of a pair of the support arms 31. The upper portion of the panel 40 may be biased towards the second sections 33 of the support arms 31 by biasing springs 44 or other suitable biasing means. When a panel 40 contacts the surface of an object to be lifted, the panel 40 can pivot about its pivot point 43 so that the surface of its pad 42 becomes parallel to the surface of the object. The length of each panel 40 as measured in the horizontal direction is not critical but is preferably such that the panels 40 on adjoining sides of the frame 20 do not interfere with each other when contacting adjoining sides of a layer. The panels 40 may be shorter than the sides of the layer which they contact, or they may be longer than the sides of the layer and have interfitting portions so that adjoining panels 40 can intersect one another. Generally, it is easier for an operator of the apparatus to position the panels 40 with respect to a layer if each panel 40 is shorter than the side of the layer which it is to contact. For example, for a layer measuring 38 inches on a side, a panel 40 having a length of approximately 34 inches has been found easy to position with respect to the layer.

The surface of each panel 40 will typically have a shape as viewed from above which is similar to the shape of the surface of the layer which the panel 40 is to contact, i.e., the surface of the panel 40 and the surface of the layer will usually be parallel to each other over most or all of the surface of the panel 40 in order to maximize the area of contact between the panel 40 and the layer and thereby reduce compressive stresses applied to the layer. For example, if the surface of the layer which the panel 40 is to contact is substantially planar, the surface of the panel 40 may be substantially planar over most or all of its length, while if the surface of the layer is curved, the surface of the panel 40 may be curved in a complementary manner. However, the panel 40 and the layer need not be similar in shape to each other, or they may have regions where opposing surfaces are similar in shape to each other and other regions where opposing surfaces are not similar in shape to each other.

The clamping arms 30 are pivoted about their respective pivot points 34 by a drive mechanism. In the present embodiment, a drive mechanism comprises a pair of actuators in the form of double-acting hydraulic cylinders 22. One end of each hydraulic cylinder 22 is pivotably connected to one of the lever arms 36, and the piston rod 23 of the hydraulic cylinder 22 is pivotably connected to the lever arm 36 at the opposite end of the frame 20. Many other types of drive mechanisms can be employed to pivot the clamping arms 30, such as drive mechanisms employing electric motors or pneumatic cylinders. Hydraulic cylinders are particularly suitable because the force which they exert can be easily regulated. Instead of double-acting hydraulic cylinders, single-acting cylinders with a return spring to retract the piston rod can also be employed. The hydraulic cylinders 22 receive hydraulic fluid under pressure through unillustrated hydraulic lines connected to a conventional hydraulic controller mounted aboard the fork lift 60. The hydraulic cylinders 22 may be disposed at different heights so as not to interfere with each other. In FIG. 2, the hydraulic cylinders 22 are disposed above the pivot points 34 so that cases 71 held by the clamping arms 30 can be stacked up to the bottom surface of the frame 20. However, the hydraulic cylinders 22 may be installed in any location which enables them to exert a torque on the support arms 31 about the pivot points 34.

Instead of employing only two hydraulic cylinders 22, each clamping arm 30 can be equipped with its own hydraulic cylinder connected between the clamping arm 30 and the frame 20.

In order to assist the operator of the apparatus in aligning the clamping portion 10 with a layer of cases 71, an alignment guide 26 is mounted on one corner of the frame 20. The alignment guide 26 comprises plates joined to form a right angle corner extending between the plates 21*a* and 21*b*. The operator maneuvers the fork lift 60 and the side shifter 50 until the outer edges of the alignment guide 26 are aligned with the comer of a layer of cases 71. If desired, similar alignment guides 26 can be mounted on other corners of the frame 20. If the frame 20 is square or rectangular instead of cross shaped, the corners of the frame 20 can serve as alignment guides.

When the piston rod 23 of a hydraulic cylinder 22 is retracted, the two clamping arms 30 connected to the hydraulic cylinder 22 pivot about the pivot points 34 in a direction causing the panels 40 to move away from each other. Conversely, when the piston rod 23 of a hydraulic cylinder 22 is extended, the two clamping arms 30 connected to the hydraulic cylinder 22 pivot in a direction causing the panels 40 to move towards each other.

Generally, it is preferable for all four panels 40 to exert the same pressure on the object held between them. Equal pressures can be readily obtained by suitably selecting the moment arms of the clamping arms 30 about the pivot point 34, the hydraulic pressures in the hydraulic cylinders 22, and the dimensions of the panels 40. For example, if all four clamping arms 30 have the same moment arm, all four panels 40 have the same contact area, and the same pressures are applied to both hydraulic cylinders 22 so that both hydraulic cylinders 22 exert the same force, the pressures applied by the panels 40 from all four directions will be equal.

In the present embodiment, the distance from the pivot point 34 to the panel 40 is the same for all four clamping arms 30, and the only difference among the clamping arms 30 is that the two clamping arms 30 which are operated by the upper hydraulic cylinder 22 have a longer lever arm 36 than the two clamping arms 30 which are operated by the lower of the two hydraulic cylinders 22. Therefore, in order for each panel 40 to exert the same clamping pressure, the pressure in the upper hydraulic cylinder 22 can be set lower than the pressure in the lower hydraulic cylinder 22.

In order for the clamping arms 30 to hold a layer of cases 71 without any of the cases 71 falling down, the lateral compressive forces exerted by the clamping arms 30 must generate frictional forces large enough to prevent slippage between the cases 71 and the pads 42, and between adjoining cases 71. Suitable lateral compressive forces can be readily determined by experimentation. Furthermore, the lateral compressive forces exerted by the clamping arms 30 are preferably low enough to prevent damage to the cases 71. The lateral compressive forces which can safely be applied to various types of goods without damage are well known in the packaging industry, and the appropriate hydraulic pressure to obtain such forces can easily be calculated once the dimensions of the clamping arms 30 are known. The force to be applied will be such that the vertical component of the frictional force between the pads 42 and the sides of the layer or layers contacted by the pads is at least equal to the weight of the layer or layers to be lifted The hydraulic controller can then control the hydraulic pressures so as not to exceed the calculated levels.

When the apparatus is used to lift a stack of cases having a plurality of layers, the panels 40 will usually contact only the one or two lowest layers in the stack. To prevent the upper layers from shifting due to the movement of the apparatus, side guards 37 can be secured to the support arms 31 or the frame 20.

The frame 20 is cantilevered from the side shifter 50 by a connecting arm 25 which is rigidly secured to the frame 20. The connecting arm 25 will usually extend parallel to one of the pairs of plates 21*a*, 21*b* of the frame 20 so that each panel 40 will be parallel to one of the sides of a layer of cases 71 to be lifted.

The frame 20 and the support arms 31 in this embodiment have fixed dimensions. However, both can be easily modified to have variable dimensions. For example, the frame 20 can be telescoping such that its width and length can be adjusted. Similarly, the second sections 33 of the support arms 31 may likewise be telescoping.

FIGS. 3A–3C illustrate one of the clamping arms 30 in various operational positions. In FIG. 3A, the clamping arm 30 is maintained by the corresponding hydraulic cylinder 22 in a position such that the pad 42 of the panel 40 mounted on the support arm 31 is spaced from the sides of cases 71 stacked on a pallet 70. In this position, the clamping portion 10 can be raised and lowered without disturbing the cases 71. In FIG. 3B, the clamping arm 30 is shown pivoted to a position in which the pad 42 is pressed against the side of a layer of cases 71 having a total width W1. In FIG. 3C, the clamping arm 30 is pivoted to a position in which the pad 42 is pressed against the side of a layer of cases 71 having a total width W2 which is smaller than W1. The other support arm 31 to which the hydraulic cylinder 22 is drivingly connected would appear, if shown, as a mirror image of the illustrated support arm 31.

Very often, a layer of cases 71 of soft drink cans has rectangular dimensions, common dimensions being 32 inches by 38 inches. In order for the clamping arms 30 to reliably grasp the layer from all four sides, it is desirable that the pads 42 of all four clamping arms 30 be at substantially the same height, regardless of which side of the layer is being contacted. In other words, the height h1 of the lower edge of the pad 42 in FIG. 3B when opposing pads 42 are separated by 38 inches is preferably substantially the same as the height h2 of the lower edge of the pad 42 in FIG. 3C when opposing pads 42 are separated by 32 inches.

In the present embodiment, in order to make h1 substantially equal to h2, the dimensions of each support arm 31 are selected such that when opposing pads 42 are separated by 38 inches, the pivot point 43 for the panel 40 is offset by a distance D to the outside of a vertical line passing through pivot point 34 for the support arm 31, as shown in FIG. 3B. Furthermore, when opposing pads 42 are separated by 32 inches, pivot point 43 is offset by the same distance D to the inside of a vertical line passing through pivot point 34, as shown in FIG. 3C. For example, in the present embodiment, the offset D is 3 inches. Even though the support arm 31 pivots about pivot point 34 from the position shown in FIG. 3B to the position shown in FIG. 3C and the pivot point 43 of the panel 40 travels along an arc centered on pivot point 34, the starting and ending heights h1 and h2 of pivot point 43 are the same, so the effect is as if the pads 42 were moved horizontally from a separation of 38 inches to a separation of 32 inches. Accordingly, the four pads 42 of the four clamping arms 30 can grasp the four sides of a layer at substantially the same height, even when the layer is an elongated rectangle.

Ideally, h1 and h2 are identical. Because of manufacturing tolerances, there may be some small differences between the two heights. However, it has been found that the clamping portion 10 can securely grasp a layer of cases 71 of soft drink cans when h1 and h2 differ by up to 1 inch.

Since the panels 40 are pivotable about pivot points 43 in this embodiment, they can always remain parallel to the sides of the layer which is to be lifted.

When the layer to be lifted is perfectly square, all four panels 40 will of course contact the layer at exactly the same height, regardless of the dimensions of the layer.

In this embodiment, a layer having dimensions differing by 6 inches can be reliably clamped at a uniform height. If the length and width of a layer to be lifted differ from one another by a different amount, the arcs along which the pivot points 43 swing can be selected so that the height of the pads 42 will remain the same at the minimum and maximum dimensions of the layer.

The side shifter 50 is adapted to be mounted on the front of the fork lift 60 by any suitable means, such as by bolts. Alternatively, it can be mounted on a different type of lifting mechanism, such as a gantry crane or a robot arm. The side shifter 50 includes a frame 51 and one or more drive members for moving the clamping portion 10 in the lateral direction of the fork lift 60. The drive members in this embodiment are double-acting hydraulic cylinders 52, but other types of drive members can be employed, such as pneumatic cylinders or electric motors with linearly moving output shafts. A counterweight 53 can be mounted on the frame 51 to balance the weight of the clamping portion 10 and the load which it holds. The fluid pressure supplied to the hydraulic cylinders 52 can be regulated by a conventional hydraulic controller aboard the fork lift 60.

The side shifter 50 may be rigidly connected to the clamping portion 10, but preferably the two are connected by a joint which allows at least a small amount of relative vertical movement between them. In FIG. 2, such a joint comprises a hinge 54 connected between the upper portions of two vertical plates 55 and 56. One plate 55 is secured to the outer ends of the hydraulic cylinders 52 of the side shifter 50, and the other plate 56 is secured to the connecting arm 25 of the clamping portion 10.

When the clamping portion 10 is lowered onto a pallet or other solid surface, it is difficult for the operator of the fork lift 60 to stop the downwards movement of the fork lift 60 as soon as contact between the clamping portion 10 and the pallet takes place. If there is a rigid connection between the clamping portion 10 and the side shifter 50, the downward movement of the entire clamping apparatus will suddenly stop when the contact takes place, and undesirable slack will developed in the chains and hydraulic lines of the fork lift 60. In contrast, when a movable joint like that illustrated in FIG. 2 is employed, when the downward movement of the clamping portion 10 is stopped by contact with a pallet, the side shifter 50 can continue to move slightly downward with the fork lift 60 as the plates 55 and 56 pivot about the axis of the hinge 54. As a result, the chains and hydraulic lines in the fork lift 60 are maintained taut.

FIG. 4 illustrates another example of a joint for connecting the side shifter 50 to the clamping portion 10. In this example, a plate 57 connected to the hydraulic cylinders 52 of the side shifter 50 slidably supports a plate 58 connected to the connecting arm 25 of the clamping portion 10 for vertical movement. A lower ledge 57*a* on plate 57 supports the weight of plate 58 and of the clamping portion 10, and guides 57*b* slidably guide the lateral edges of plate 58. When the clamping portion 10 is lowered onto a pallet which prevents its further downwards movement, the side shifter 50 can continue to move slightly downwards with the fork lift 60 as the two plates 57 and 58 slide with respect to each other, thereby maintaining the chains and hydraulic lines in the fork lift 60 taut.

The side shifter 50 of this embodiment moves the clamping portion 10 in the lateral direction of the fork lift 60, but it may be modified so as to move the clamping portion 10 in the fore and aft direction of the fork lift 60. It is also possible to omit the side shifter 50 and mount the clamping portion 10 directly on the fork lift 60, preferably employing a movable joint, such as the hinge 54 of FIG. 2 or the joint shown in FIG. 4.

In order to operate the embodiment of FIG. 1, the operator of the fork lift 60 drives the fork lift 60 until the clamping portion 10 is disposed opposite a pallet 70 containing cases 71 which are to be moved. The operator then uses the side shifter 50 to maneuver the clamping portion 10 until it is directly above the top layer of cases 71 on the pallet 70. The clamping portion 10 is then lowered by means of the fork lift 60 until the pads 42 of the clamping arms 30 are disposed opposite the sides of the lowest layer of cases 71 to be lifted. At this time, the clamping arms 30 are in an outwardly pivoted position, as shown in FIG. 3A, so that the pads 42 will not strike the cases 71 as the clamping portion 10 is being lowered. The hydraulic cylinders 22 are then operated to pivot the clamping arms 30 inwards until each of the four pads 42 is pressed against one of the sides of a layer with a predetermined force, as shown in FIG. 3B or 3C. When the pressure in each hydraulic cylinder 22 reaches a predetermined value, the hydraulic controller maintains the pressure at that value so that the layer is securely held by the clamping arms 30 without being crushed. The fork lift operator then raises the clamping portion 10 by means of the fork lift 60, and the layer of cases 71 grasped by the clamping arms 30 and any layers stacked above that layer are lifted off the pallet 70 to be moved by the fork lift 60 to a desired location and lowered onto a different pallet 70 or other surface. Once the layer or layers of cases 71 held by the clamping arms 30 are stably disposed on the different pallet 70, the clamping arms 30 are swung outwards as shown in FIG. 3A to release the cases 71.

In contrast to a manual worker who can transfer cases between pallets only one case at a time, a clamping apparatus according to the present invention can move entire layers of cases at a time, so productivity is enormously increased. For example, it is expected that an average fork lift operator can move over 2000 cases per hour using the clamping apparatus according to the present invention, which is four times the rate that a typical worker can move cases by hand. Furthermore, since all lifting is done by the clamping apparatus and the fork lift, injuries to workers resulting from lifting cases by hand for long periods can be greatly reduced.

In the embodiment of FIG. 1, the orientation of the frame 20 with respect to the fork lift 60 is fixed. In some instances, however, it is useful to be able to rotate an entire layer of cases on a pallet in order to access cases located in the rear of the layer. FIG. 5 illustrates an embodiment of the present invention in which the frame 20 of the clamping portion 10 can be rotated about a vertical axis passing through the center of the frame 20 while the clamping portion 10 is supporting a layer. The frame 20 is rotatably supported by the connecting arm 25 for rotation about a pivot point 27. The rotational position of the frame 20 can be adjusted by a hydraulic cylinder 28 or other suitable drive member rotatably connected at its ends between the connecting arm 25 and the frame 20. When the output shaft of the hydraulic cylinder 27 is extended or retracted, the frame 20 is rotated by 90 degrees in the counterclockwise or clockwise directions, respectively, in the figure.

In the above-described embodiments, all four of the clamping arms 30 are pivotably supported for pivoting about a horizontal axis. However, it is also possible for one clamping arm 30 of each pair of opposing clamping arms 30 to be fixed, and for only the opposing clamping arm 30 of each pair to be pivotable.

When the clamping apparatus is used to lift a plurality of unconnected objects, such as a layer of cases 71, it is usually desirable to grasp the objects with the clamping arms 30 from all four sides. However, if the objects are rigidly connected together, or if there is only a single large object to be lifted, it may be possible to lift the object with only a single pair of clamping arms 30 grasping the object along two opposing sides. Therefore, in such a situation, it is possible for a clamping apparatus according to the present invention to have less than four clamping arms 30, such as only two clamping arms 30.

In the illustrated embodiment, the soft drink cans are housed in cases 71. However, since the clamping arms 30 can apply a uniform pressure from four sides simultaneously, the clamping apparatus can also be used to lift a plurality of loose cans or bottles, not disposed in cases.

Figure 6:
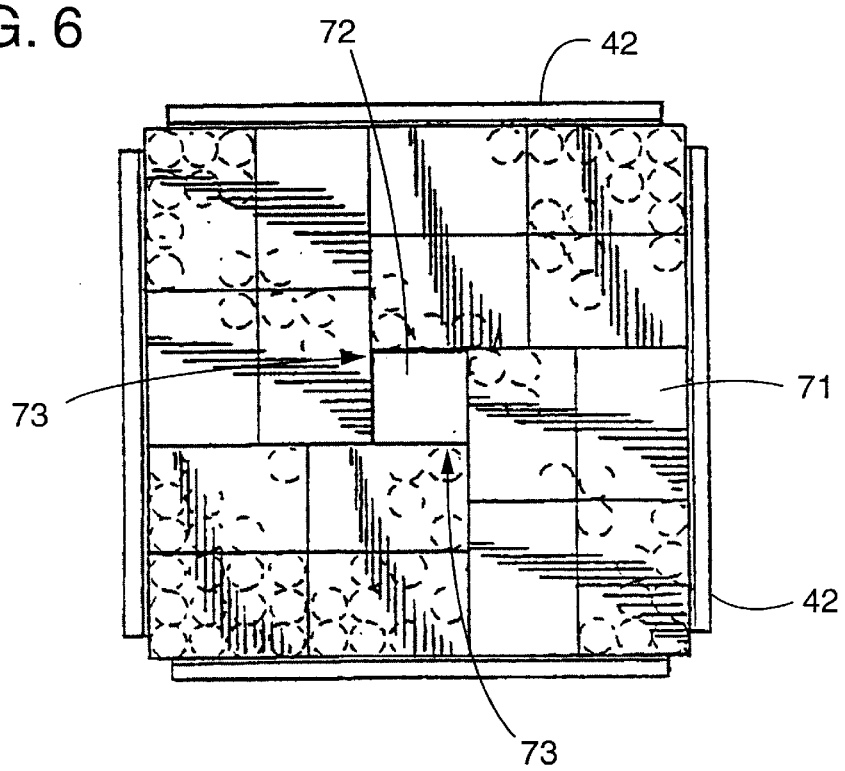
FIG. 6 is a plan view of a stack of 12-packs of soft drinks in which each layer in the stack has a cavity at its center.

Frequently, objects stacked on a pallet in layers cannot be formed into solid layers of prescribed dimensions due to the dimensions of the individual objects. In such cases, the objects may be formed into layers containing cavities. For example, it is common to stack cases or packs of canned soft drinks on a rectangular pallet in the configuration shown in FIG. 6, which is a plan view of a typical stack of canned soft drinks on a pallet. In this configuration, each layer in the stack contains a cavity 72 at its center, the cavity 72 extending over the entire height of the stack. A typical 12-pack of soft drinks holds 12 cans arranged in an array of 3 cans by 4 cans, so in the example shown in FIG. 6 in which each layer contains sixteen 12-packs 71, the cavity 72 is square and measures 2 cans wide and 2 cans long. As another example, 12-packs of canned soft drinks are frequently stacked in elongated rectangular layers each containing eighteen 12-packs, with each layer having an elongated rectangular cavity at its center measuring 2 cans wide and 4 cans long. When the pads 42 of the clamping arms 30 of the embodiment of FIGS. 1–5 are pressed against the outside of such a layer in order to lift it, the cavity 72 may allow some shifting of the cases or packs, which is undesirable, since the shifting may result in the outer surface of the stack becoming irregular so that the clamping arms 30 cannot be pressed flat against the outer surface. Furthermore, because of the presence of the cavity 72, the stresses in locations such as those indicated in FIG. 6 by reference numeral 73 where a corner of one 12-pack 71 abuts against the side of another 12-pack 71 are increased, possibly resulting in deformation of the cans within the 12-packs 71.

Figure 7:
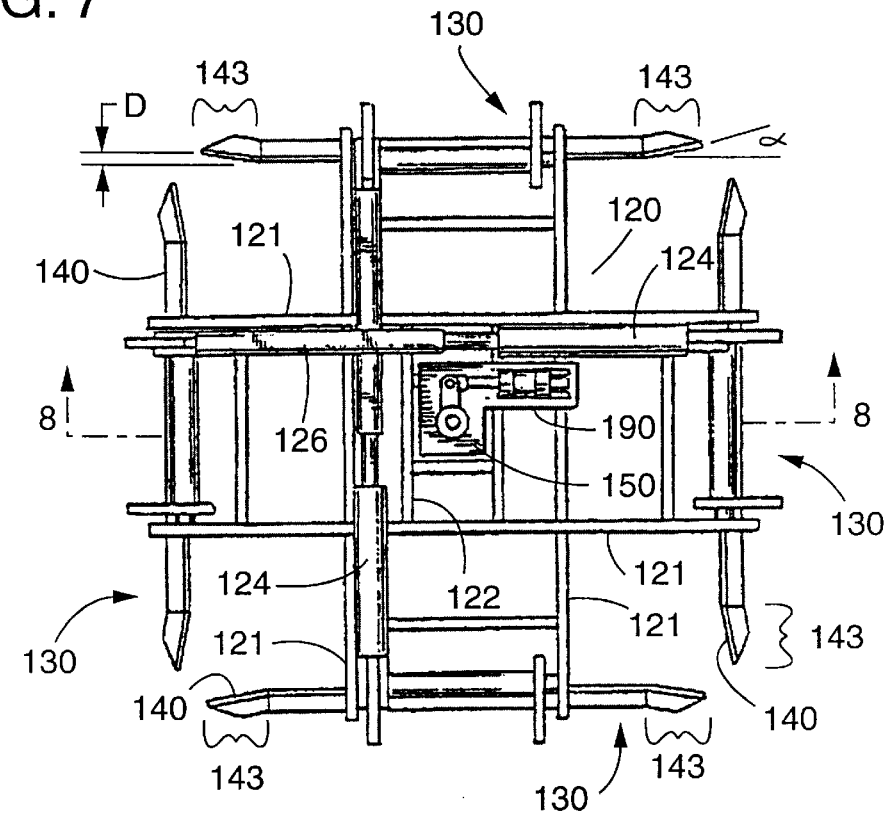
FIG. 7 is a plan view of an embodiment of the present invention which is equipped with an internal support for reinforcing the walls of a cavity in a stack.

FIGS. 7–18 illustrate another embodiment of a clamping apparatus according to the present invention which is equipped with an internal support 150 which can be inserted into a cavity 72 within a layer to prevent shifting and deformation of objects contained in the layer and adjoining the cavity 72. The overall structure of this embodiment is similar to that of the embodiment of FIG. 1. As shown in FIG. 7, which is a plan view, and FIGS. 8 and 9, which are partially cross-sectional elevations taken along line 8—8 of FIG. 7, this embodiment includes a clamping portion 100 having a rigid, cross-shaped frame 120 which pivotably supports four clamping arms 130 so as to define a square space. The frame 120 is formed from a plurality of plates 121 or other structural members which are rigidly secured to each other in the shape of a cross. Two of the clamping arms 130 are pivotably mounted in opposing relationship on opposite sides of the frame 120 for pivoting about parallel horizontal axes, and the first two clamping arms 130 are pivotably mounted in opposing relationship on opposite sides of the frame 120 for pivoting about parallel horizontal axes extending perpendicular to the axes of pivoting of the other two clamping arms 130. The clamping arms 130 are similar in shape to the clamping arms 30 of the embodiment of FIGS. 1–5, with each clamping arm 130 including a pair of support arms 131 pivotably supported by the frame 120 at a pivot point 134, and a panel 140 disposed at the lower end of the support arms 131 for contacting a side of a layer of objects to be lifted. The support arms 131 are connected with each other near their upper ends by a hollow pipe 132 which surrounds and is rotatably supported by an axle 133 which is attached to the frame 120 at the pivot points 134. The support arms 131 may also be secured to each other at their lower ends by a structural member 135 such as a rod or a pipe. Each panel 140 comprises a rigid elongated channel-shaped frame 141 secured to the lower ends of the support arms 131 and a resilient pad 142 of rubber or similar material mounted on the inner side of the frame 141. The panels 140 may be pivotably secured to the support arms 131 as in the embodiment of FIGS. 1–5, but when the clamping portion 100 is equipped with an internal support 150 as in the present embodiment, it is easier to position the frame 120 of the clamping portion 100 with respect to a stack of objects to be lifted if the panels 140 are rigidly secured to the support arms 131. The clamping arms 130 are pivoted about their respective pivot points 134 by actuators in the form of a pair of double-acting hydraulic cylinders 124 each having a piston rod 125 which can be advanced and retracted. Each hydraulic cylinder 124 is pivotably connected at one end to a lever 136 of one of the support arms 131. The outer end of the piston rod 125 of each hydraulic cylinder 124 is secured to one end of a rigid extension member 126, such as a rod or a piece of hollow rectangular bar stock, while the other end of the extension member 126 is pivotably connected to the lever 136 of another of the support arms 131.

When the clamping portion 100 is used to lift a stack containing a plurality of layers, the panels 140 sometimes contact only the lower portion of the stack, depending upon the height of the individual layers relative to the height of the panels 140. Therefore, each of the clamping arms 130 may be equipped with a lateral support member 137 for steadying the upper layers in a stack against movement. The lateral support member 137 may be permanently fixed in a single location on the clamping arms 130 like the side guards 37 shown in FIG. 2, or they may be adjustably mounted on the clamping arms 130. In the present embodiment, each lateral support member 137 is substantially L-shaped and includes a plate **137*a* which can be secured to one of the support arms 131 and a restraining rod 137*b* which extends from the plate 137*a* parallel to the axis of pivoting of the clamping arm 130 on which it is mounted. The plates 137*a* are adjustably secured to the support arms 131 by bolts 137*c* passing through the plates 137*a* and the support arms 131. By loosening the bolts 137*c*, the angle of the plates 137*a* with respect to the support arms 131, and therefore the distance of the restraining rods 137*b* from the support arms 131**, can be readily adjusted.

If a panel 140 has a length as measured in the horizontal direction which is less than the length of the side of a layer which the panel 140 is to contact, the lengthwise ends of the panel 140 may dent or otherwise damage the portions of the layer contacted by the lengthwise ends if the contact produces a sharp stress gradient in the layer at the lengthwise ends, i.e., if the stress acting on the layer suddenly drops off to zero just past the lengthwise ends of the panel 140. Examples of such damage are unsightly dents in soft drink cans or creases in cardboard boxes in the layer. To reduce the tendency of the lengthwise ends of the panels 140 to deform the layer being contacted, the panels 140 may be shaped such that the pressure applied to the layer gradually decreases towards the lengthwise ends of the panels 140. One way of shaping a panel 140 to reduce the pressure at its lengthwise ends is to slope the lengthwise ends away from the side of the layer to be contacted by the panel 140. When a panel 140 with sloping ends is pressed against a layer, the sloping ends will contact the layer after the lengthwise midportion of the panel 140 does so and will not compress the layer as much as the midportion, so the compressive stresses applied to the layer will be lower at the lengthwise ends than at the midportion. FIG. 7 shows an example of panels 140 having sloping lengthwise ends 143. The lengthwise midportion of each panel 140 is substantially planar, while the two lengthwise ends 143 are gradually sloped with respect to the midportion away from the center of the apparatus and away from the side of a layer to be contacted by the panel 140. The lengthwise ends 143 in FIG. 7 are sloped along straight lines as viewed in plan, but they may instead extend along curves. The angle of slope a of the lengthwise ends 143 with respect to the midportion is preferably gradual, such as on the order of approximately 10 to at most approximately 20 degrees, to avoid a sharp stress gradient in the layer, and the transitions between the planar midportion and the lengthwise ends 143 of the panel 140 are preferably as smooth as possible (such as rounded) to avoid sharp corners which might damage the layer.

The horizontal distance D by which the tips of the lengthwise ends 143 are set back from the midportion of the panel 140 (measured in the direction away from the side of the layer to be contacted) is preferably greater than or equal to the expected amount of horizontal compression of the layer at the lengthwise midportion of the panel 140 when the panel 140 is pressed against the layer with the usual amount of force required for the clamping apparatus to support the layer being grasped and any layers above it. If the distance D is approximately equal to the expected compressive of the layer at the midportion, the tips of the lengthwise ends 143 will lightly contact the layer, while if the distance D is greater than the expected compression, the tips of the lengthwise ends 143 will be spaced from the sides of the layer. For a layer containing soft drink cans, an example of a suitable value for D is approximately ½ inch or greater with the angle a being approximately 10 to 20 degrees.

Figure 8:
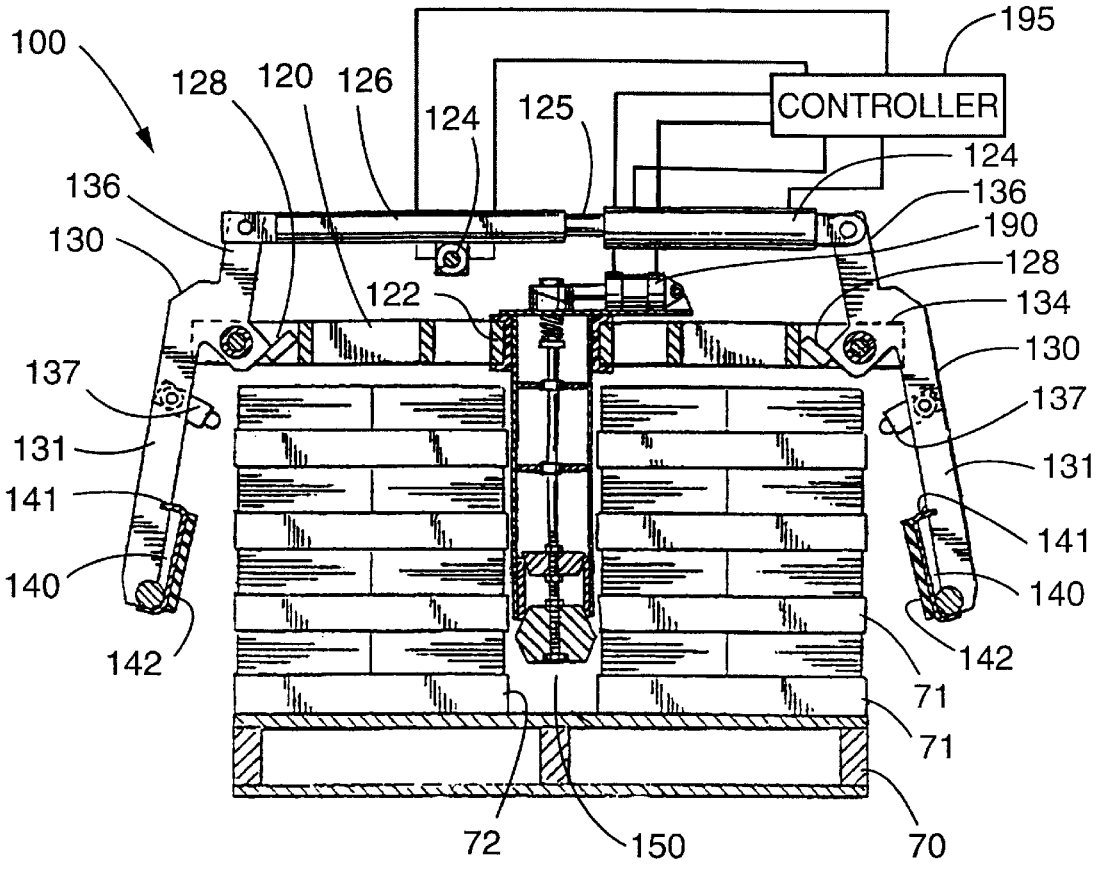
FIG. 8 is a cross-sectional view taken along Line 8—8 of FIG. 7 with the paddles of the internal support in a retracted position.

When the piston rods 125 of the hydraulic cylinders 124 are retracted, the clamping arms 130 are swung outwards, i.e., away from each other as shown in FIG. 8, and when the piston rods 125 are advanced, the clamping arms 130 are swung inwards, i.e., towards each other as shown in FIG. 8 to contact the sides of a layer of objects to be lifted. In order to limit the amount by which the clamping arms 130 swing outwards, the frame 120 may be equipped with mechanical stops 128 against which some portion of the clamping arms 130 abuts when the clamping arms 130 have pivoted outwards to a predetermined angle. In the present embodiment, the mechanical stops 128 comprise plates which are detachably bolted to the frame 120.

During use, the clamping portion 100 can be supported in any desired manner. For example, it can be mounted on a side shifter of a fork lift as in the embodiments of FIGS. 1–5 so as to be situated to one side of the fork lift, it can be mounted on the front of a fork lift, or it can be supported by a different member, such as a crane or a robot arm.

The location of the internal support 150 on the frame 120 will depend upon the location of the cavity 72 in the stack of objects to be lifted. The location is preferably such that with the internal support 150 disposed inside a cavity 72, the clamping arms 130 can stably contact the outer sides of a layer in the stack. If the cavity 72 is at the geometric center of the stack as viewed from above, the internal support 150 will typically be supported at the geometric center of the frame 120 as viewed from above, i.e., midway between each pair of opposing clamping arms 130. However, if the cavity 72 is not at the geometric center of a stack, the location of the internal support 150 on the frame 120 can be changed accordingly. In the present embodiment, the internal support 150 is disposed at the geometric center of the frame 120 as viewed in plan.

The internal support 150 includes a vertically-extending support portion in the form of a support frame 151 supported by the frame 120 of the clamping portion 100 and a plurality of reinforcing members in the form of paddles 160 for reinforcing the inner walls of the cavity 72 movably mounted on the lower end of the support frame 151. When the internal support 150 is in its normal operating position with respect to the frame 120, the paddles 160 are preferably at approximately the same height as the pads 142 of the clamping arms 130 when the pads 142 are contacting the outer surface of a layer of objects to be lifted, i.e., each paddle 160 lies along an imaginary line connecting the pads 142 of opposing clamping arms 130. The number of paddles 160 and their orientation with respect to each other can be selected in accordance with the shape of the cavity 72 into which the internal support 150 is to be inserted. It may be desirable for the paddles 160 when viewed from above to define a shape which is similar to the peripheral shape of the cavity 72 when viewed from above. For example, when the cavity 72 is rectangular (such as square) when viewed from above, the paddles 160 can be arranged on the support frame 151 to coincide with four sides of a rectangle similar in shape to the cavity 72, and if the cavity is circular, the paddles 160 may define arcs of a circle. In the present embodiment, the paddles 160 coincide with the sides of a square. However, any shape which enables the paddles 160 to reinforce the walls of the cavity 72 can be employed. Thus, paddles 160 which define arcs of a circle may be used to reinforce a rectangular cavity 72.

An internal support having the same number of paddles as there are sides to the cavity 72 can provide maximum support to the cavity 72. However, not all the sides of the cavity may need reinforcement, so one or more of the paddles 160 can be omitted.

The support frame 151 of the internal support 150 preferably has outer dimensions which are small enough for the support frame 151 to be easily inserted into a cavity 72 in a layer of objects to be lifted. The illustrated support frame 151 is an elongated hollow member with a constant transverse cross section of rectangular shape and four substantially vertical, plate-shaped walls 152 parallel to the inner walls of the cavity 72. However, in this embodiment, the primary purpose of the support frame 151 is to support the paddles 160, and the support frame 151 itself does not need to contact the inner walls of the cavity 72, so there is no restriction on the transverse cross-sectional shape of the support frame 151 and it need not resemble that of the cavity 72. In addition, the transverse cross-sectional shape of the support frame 151 may vary over its height. Furthermore, instead of having plate-shaped walls 152 forming its sides, the support frame 151 may be skeletal in structure with open sides. Thus, the support frame 151 may have any structure which enables it to support the paddles 160. Preferably, there is enough clearance between the sides of the support frame 151 and the walls of the cavity 72 that the internal support 150 can be easily inserted into the cavity 72.

Figure 9:
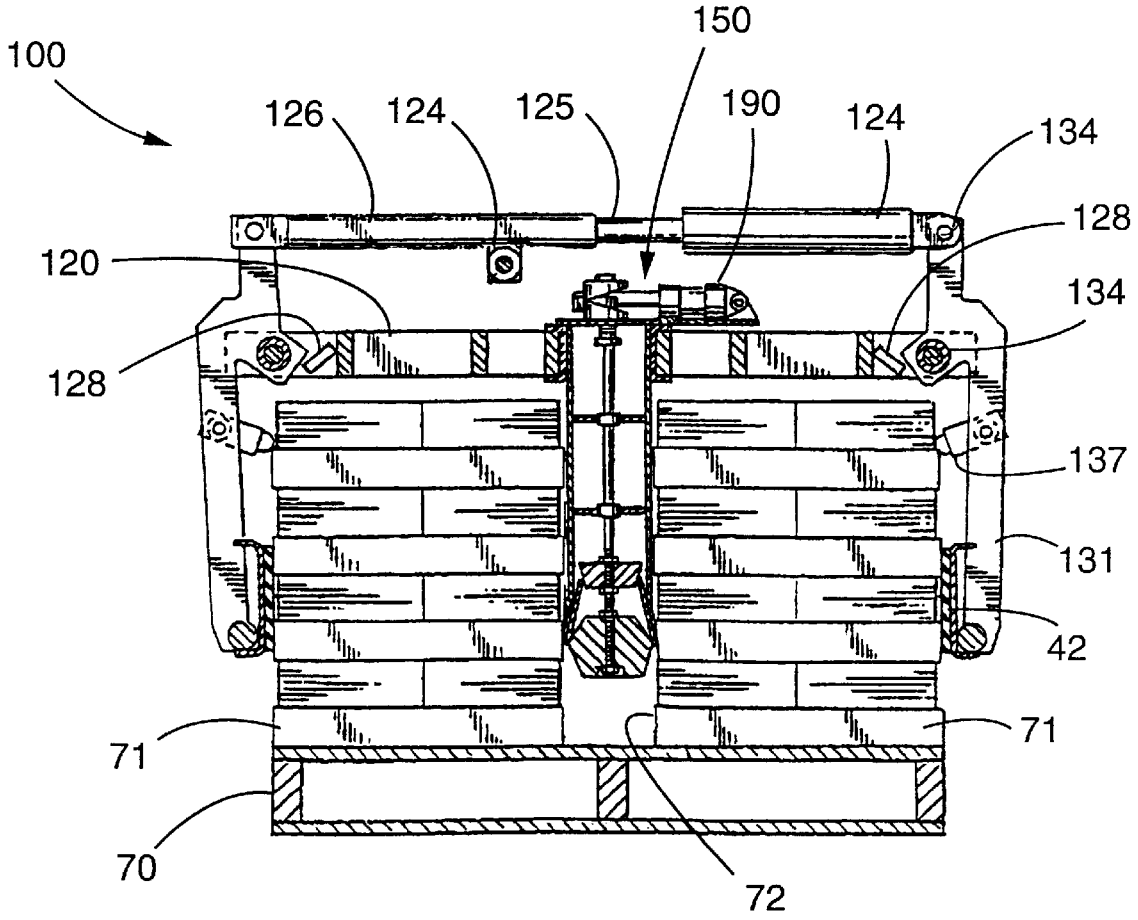
FIG. 9 is a cross-sectional view taken along Line 8—8 of FIG. 7 with the paddles of the internal support in an extended position.
Figure 10:
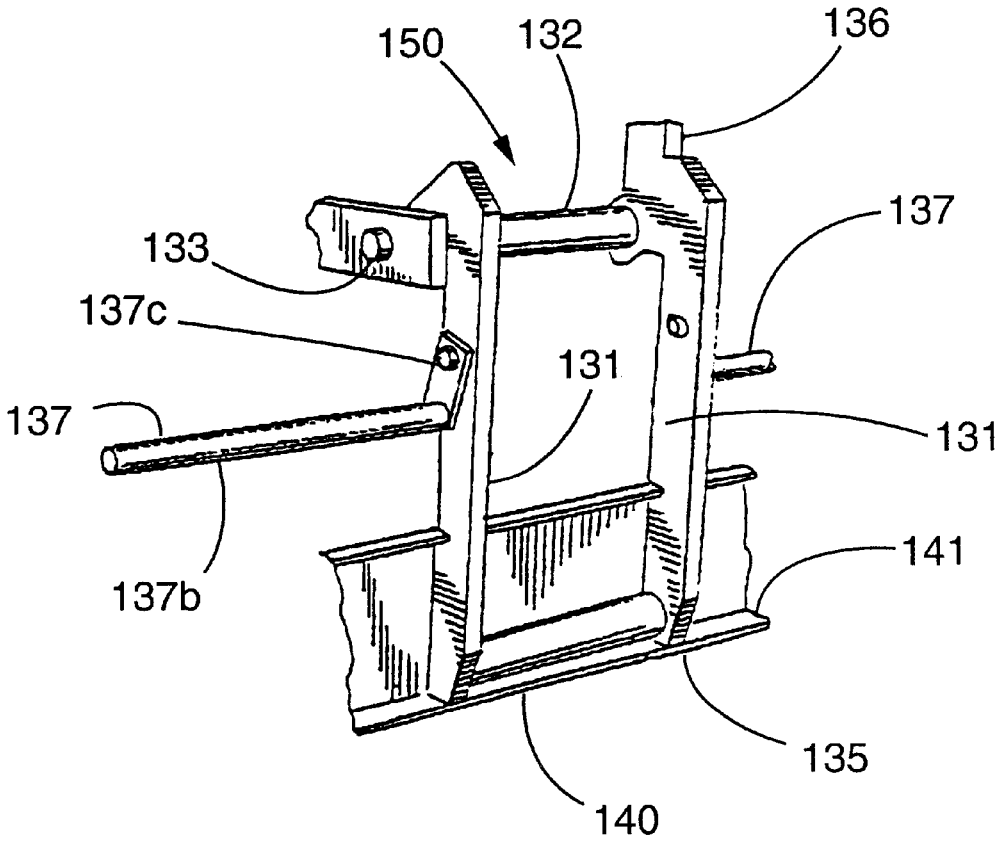
FIG. 10 is a perspective view of one of the clamping arms of the embodiment of FIG. 7.
Figure 11:
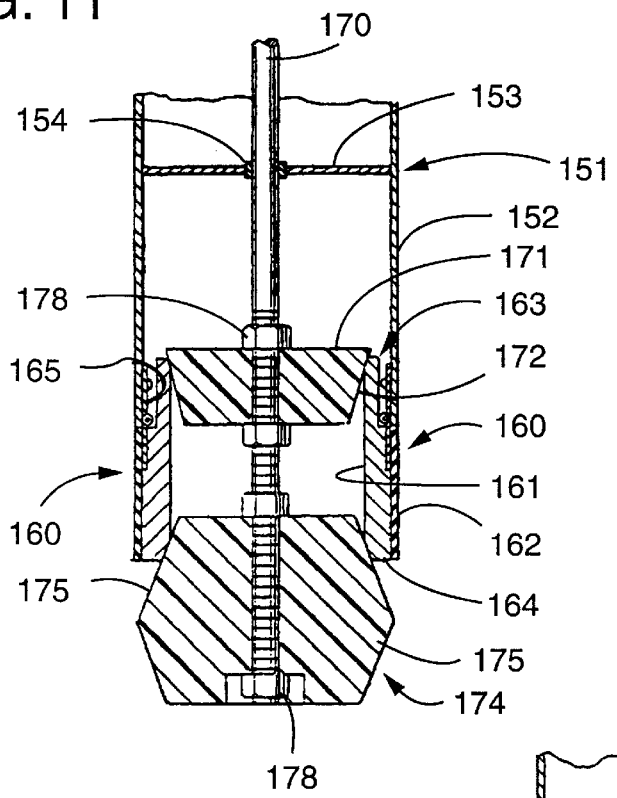
FIGS. 11 and 12 are vertical cross-sectional views of the lower portion of the internal support.
Figure 12:
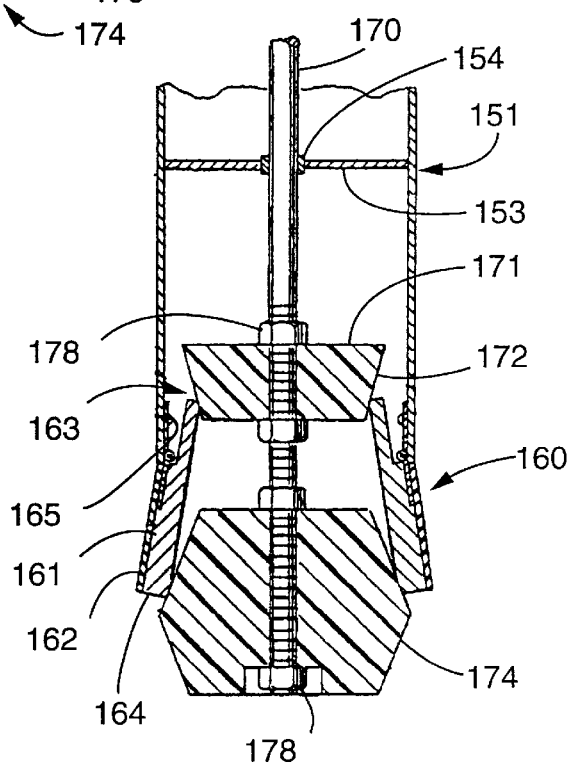

The paddles 160 are supported by the support frame 151 for movement between a retracted position, shown in FIGS. 8 and 11, and an extended position, shown in FIGS. 9 and 12, in which the paddles 160 are closer to the walls of the cavity 72 than in their retracted position. In the present embodiment, the paddles 160 are spaced from the inner walls of the cavity 72 in their retracted position to enable the internal support 150 to be readily inserted into a cavity 72, and the paddles 160 either contact or are in close proximity to the inner walls of the cavity 72 in their extended position in order to reinforce the inner walls and prevent shifting of the objects bordering on the cavity 72. Preferably, when the paddles 160 are in their extended positions, they contact the inner walls of the cavity 72. In this embodiment, when the paddles 160 are in their retracted positions, the outer surfaces of the paddles 160 which oppose the inner walls of the cavity 72 are substantially flush with the outer surface of the support frame 151.

The paddles 160 may be moved between their retracted and extended positions by any sort of movement, such as by pivoting about an axis, translation along an axis, or by a combination of several types of movement such as a combination of translation and rotation. The illustrated paddles 160 move between their retracted and extended positions by pivoting about four substantially horizontal axes at the same height and coinciding with the four sides of a square.

The paddles 160 need not have any particular shape. Preferably, the surface of each paddle 160 which opposes an inner wall of the cavity 72 is shaped so as to be capable of stably contacting the inner wall. For example, if the inner wall to be contacted is planar, the paddles 160 may have a flat portion which can be placed into line or surface contact with the inner wall of the cavity 72, while if the inner wall is curved, the portions of the paddles 160 which contact the inner wall may be similarly curved. In the present embodiment, each paddle 160 has a substantially flat body 161 made of a rigid material such as metal or hard plastic. A pad 162 of rubber or other resilient material may be attached to the outer side of the body 161 opposing the inner walls of the cavity 72 to prevent the paddles 160 from damaging the objects adjoining the inner walls of the cavity 72. If desired, the surfaces of the pads 162 opposing the inner walls of the cavity 72 may be textured (formed with a tread or serrations, for example) to increase the friction between the pads 162 and the cavity 72. The body 161 of each paddle 160 is pivotably connected to the lower end of the support frame 151 by a hinge 165 which pivots about a horizontal axis.

In this embodiment, the portions of the paddles 160 which contact the inner walls of the cavity 72 are substantially planar, and the paddles 160 are supported such that the rubber pads 162 are slightly sloped with respect to the inner walls of the cavity 72 when the paddles 160 are in their extended positions. However, the paddles 160 can be supported such that in their extended positions, they are pressed flat against the inner walls of the cavity 72.

The paddles 160 can be moved between their retracted and extended positions by any type of mechanism. In the present embodiment, the paddles 160 are moved by an operating mechanism including upper and lower cams 171 and 174 in sliding engagement with the paddles 160 and connected to an operating rod 170 supported by the support frame 151 for vertical movement in the axial direction of the operating rod 170. The two cams 171 and 174 move together with the operating rod 170 between a lowered position shown in FIG. 11 and a raised position shown in FIG. 12, both figures being vertical cross-sectional views of the lower end of the internal support 150.

Figure 13A:
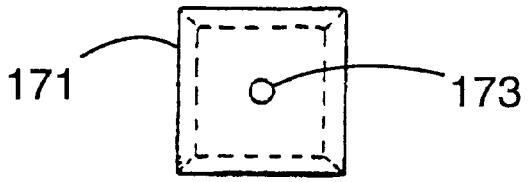
FIGS. 13*a* and 13*b* are a top view and an elevation of the upper cam of FIG. 11.
Figure 13B:
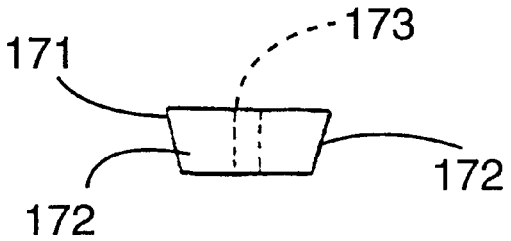
Figure 14A:
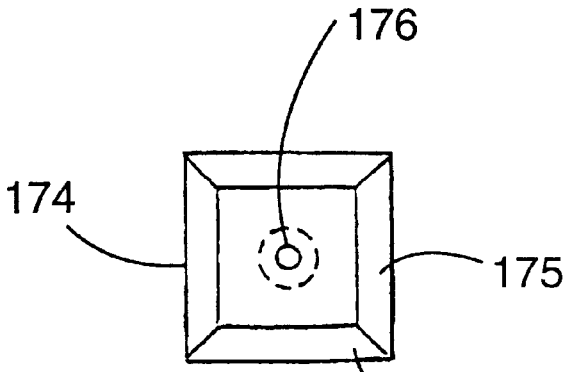
FIGS. 14*a* and 14*b* are a top view and an elevation of the lower cam of FIG. 11.
Figure 14B:
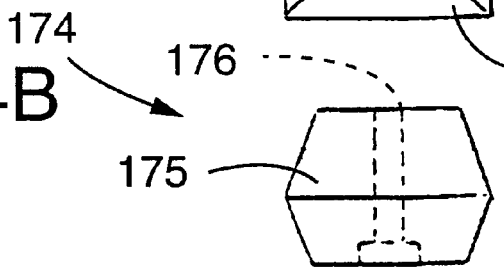

The cams 171 and 174 can have any shapes which enable them to cause the paddles 160 to pivot between their retracted and extended positions as the cams 171 and 174 are moved up and down. As shown in FIGS. 13*a* and 13*b*, which are respectively a top view and a side view, the upper cam 171 in this embodiment has the shape of a frustum of a right pyramid. Namely, it has a generally trapezoidal vertical cross section and includes four planar sides 172 which slope inwards from the upper end towards the lower end of the upper cam 171. A hole 173 is formed through the height of the upper cam 171 for receiving the operating rod 170. FIGS. 14*a* and 14*b* are respectively a top view and a side view of the lower cam 174. This cam 174 has an upper portion in the shape of a frustum of a right pyramid with four planar sides 175 which slope inwards towards its upper end. The lower portion of the lower cam 174 may have any desired shape. For example, it may be flat or curved, or it may slope inwards, e.g., it may be beveled or conically tapered to make it easier to insert the internal support 150 into a cavity 72 within a layer. The operating rod 170 passes through a hole 176 extending through the height of the lower cam 174. The cams 171 and 174 are secured to the operating rod 170 by any suitable means, such as by nuts 178 engaging with threads formed on the operating rod 170. The vertical spacing between the two cams 171 and 174 is set such that each paddle 160 can be in sliding contact with one of the sloping sides 172 of the upper cam 171 and with one of the sloping sides 175 of the lower cam 174. When the operating rod 170 is lowered with respect to the support frame 151, the upper cam 171 contacts the upper end 163 of each paddle 160 and exerts a torque on the paddles 160 about the axes of the hinges 165 to pivot the paddles 160 towards their retracted positions. When the operating rod 170 is raised with respect to the support frame 151, the lower cam 174 contacts the lower end 164 of each paddle 160 and exerts a torque on the paddles 160 to pivot them towards their extended positions.

The sloping sides 172 and 175 of the upper and lower cams 171 and 174 need not have a constant slope with respect to the vertical, and they may be curved. Furthermore, instead of having a plurality of sloping sides, the cams 171 and 174 may be bodies of revolution. For example, the portions of the cams 171 and 174 which contact the paddles 160 may be conical. However, the shapes of the sloping sides of the cams 171 and 174 are preferably selected such that as the operating rod 170 moves upward and downward, the upper and lower ends 163 and 164 of the paddles 160 can remain in contact with or be at most slightly spaced from the sloping portions of both cams 171 and 174. To decrease friction, between the paddles 160 and the cams 171 and 174, the portions of the paddles 160 which contact the cams 171 and 174 may be equipped with rollers, or the paddles 160 and/or the sloping sides 172 and 175 of the cams 171 and 174 may have a low-friction coating.

In this embodiment, the shapes and dimensions of the paddles 160 and the cams 171 and 174 are such that all four paddles 160 are at the same height and at the same angle with respect to the vertical as each other at any given time. However, as long as the paddles 160 are able to reinforce the inner walls of a cavity 72, they need not be at identical heights or angles.

The cams 171 and 174 may be made of a wide variety of materials, such as metals, rubber, wood, and various plastics. Plastics are particularly suitable on account of their ease of manufacture, light weight, and economy.

Figure 15:
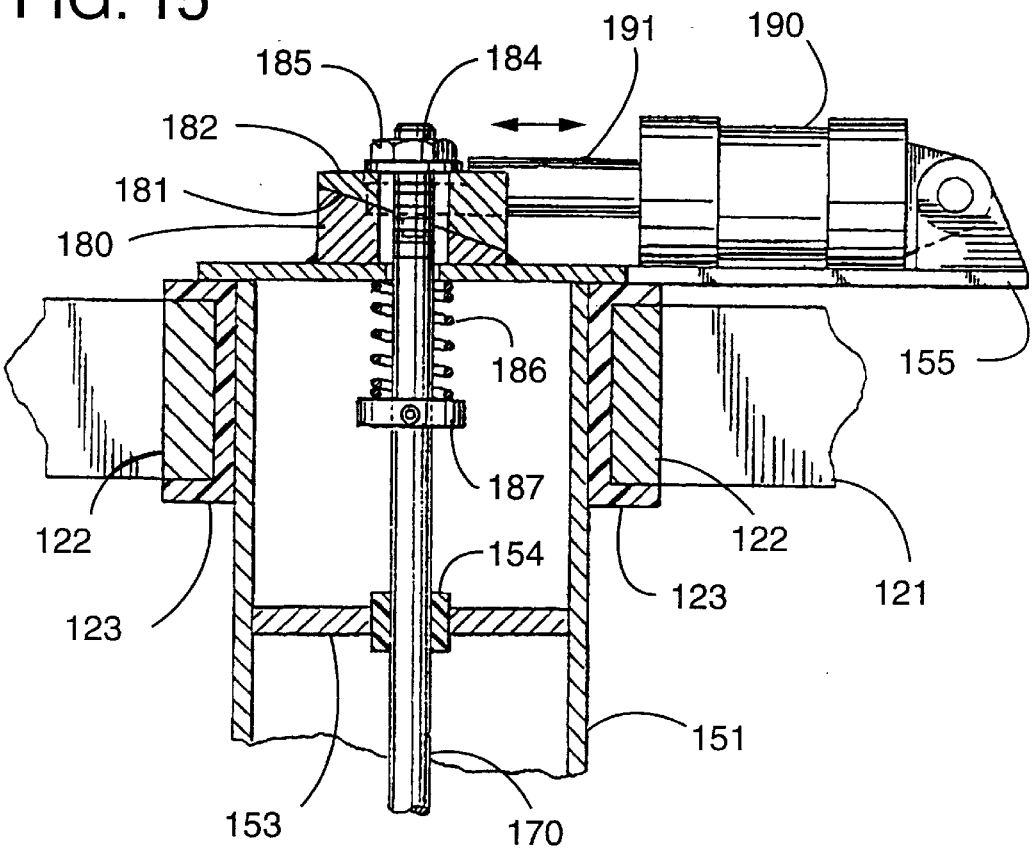
FIG. 15 is a vertical cross-sectional view of the upper portion of the internal support.

The operating rod 170 is slidably supported by the support frame 151 at several locations along its length by plates 153 secured to the outer walls 152 of the support frame 151 and by plastic bushings 154 disposed in holes in the plates 153 and surrounding the operating rod 170. The operating rod 170 can be raised and lowered with respect to the support frame 151 by a lifting mechanism disposed at the upper end of the support frame 151. As shown in FIG. 15, which is a vertical cross section of the upper portion of the internal support 150, the lifting mechanism includes first and second hollow cams 180 and 182 disposed atop the support frame and having opposing complementary cam surfaces. The first cam 180 is secured to the upper surface of the support frame 151 by welding, for example, and the second cam 182 is slidably mounted atop the first cam 180 for rotation with respect to the first cam 180 about the axis of the operating rod 170. The operating rod 170 passes loosely through a hole formed in the upper surface of the support frame 151 and through holes formed in the cams 180 and 182. The upper end of the operating rod 170 is supported such that the second cam 182 can rotate with respect to the operating rod 170 while the second cam 182 supports the weight of the operating rod 170 and cams 171 and 174. In this embodiment, the second cam 182 is in sliding contact with a washer 184 which fits over the operating rod 170 and is held in place atop the second cam 182 by a nut 185. The second cam 182 can be rotated about the axis of the operating rod 170 by a lever 188 secured to the second cam 182. When the lever 188 is pivoted to rotate the second cam 182, the lower surface 183 of the second cam 182 slides along the upper surface 181 of the first cam 180, and the first cam 180 exerts a camming action on the lower surface 183 of the second cam 182 to raise or lower the second cam 182 with respect to the support frame 151 and raise or lower the operating rod 170. The cams 180 and 182 thus convert the rotation of the lever 188 into axial movement of the operating rod 170. To ensure good contact between the operating rod 170 and the second cam 182, a biasing spring 186 in the form of a compression spring is connected between the support frame 151 and the operating rod 170. The biasing spring 186 is disposed around the operating rod 170 with the upper end of the spring 186 contacting the support frame 151 and the lower end contacting a collar 187 secured to the operating rod 170 by a set screw, for example. To reduce wear of the cams 180 and 182, a plastic bushing, a low-friction lining, or similar protective member can be disposed between the opposing surfaces 181 and 183 of the cams.

Figure 17:
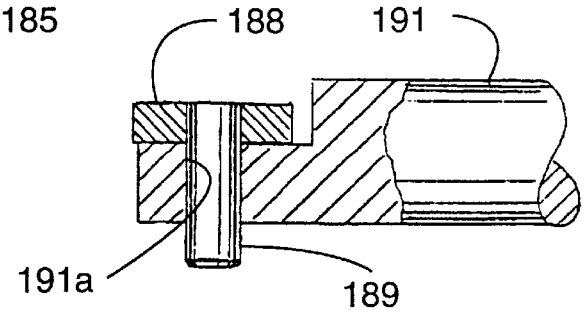
FIG. 17 is a partly cross-sectional elevation of the outer end of the piston rod of the hydraulic cylinder of FIG. 16.

The lever 188 for rotating the second cam 182 may be driven in any suitable manner. In the present embodiment, the lever 188 is operated by its own actuator, which can be controlled independently or together with the hydraulic cylinders 124 for the clamping arms 130, or it can be operated by a drive mechanism for some other component of the clamping portion 100. The illustrated actuator is a double-acting hydraulic cylinder 190 having a piston rod 191 connected to the lever 188, but any other suitable type of actuator, such as a motor, may be used. As shown in FIG. 17, in this embodiment, the lever 188 is connected with the piston rod 191 by a pin 189 which is secured to the outer end of the lever 188 and passes loosely through a hole 191*a* formed in the outer end of the piston rod 191.

Figure 16:
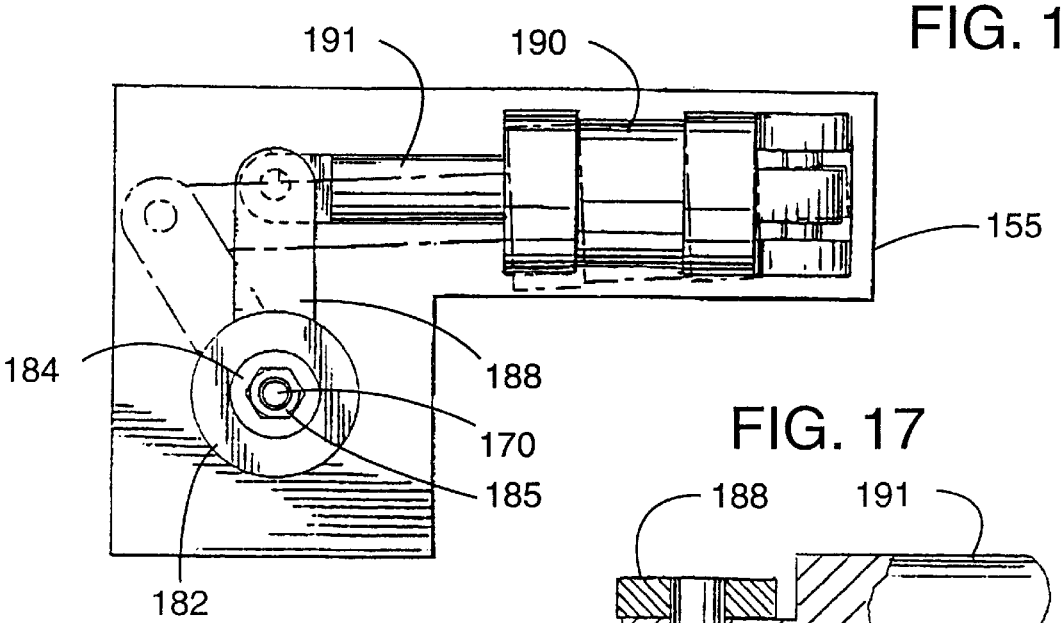
FIG. 16 is a top view of the internal support.

As shown in FIG. 16, which is a top view of the internal support 150, the lever 188 in this embodiment is moved by hydraulic cylinder 190 between a first position shown by solid lines and a second position shown by dashed lines. In the first position, the second cam 182 is in a rotational position with respect to the first cam 180 such that the operating rod 170 is lowered and the paddles 160 are in their retracted positions shown in FIG. 11. When the lever 188 is rotated to its second position, the second cam 182 is rotated with respect to the first cam 180 such that the operating rod 170 is raised and the paddles 160 are moved to their extended positions shown in FIG. 12. In the present embodiment, the hydraulic cylinder 190 is controlled in synchrony with the hydraulic cylinders 124 for the clamping arms 130 by a controller 195 (which is schematically illustrated in FIG. 8) so that the lever 188 is moved to its first position when the clamping arms 130 are spaced from the sides of a layer to be lifted, and the lever 188 is moved to its second position when the clamping arms 130 are swung inwards so that the pads 142 contact a layer to be lifted. Any type of controller capable of coordinating the operation of hydraulic cylinder 190 with the operation of hydraulic cylinders 124 can be employed, such as a hydraulic control valve connected between the hydraulic cylinders 124 and 190 and a source of hydraulic pressure.

In the present embodiment, the upper cam 171 functions to pivot the paddles 160 to their retracted positions when the operating rod 170 is lowered, i.e., the upper cam 171 presses against the upper ends 163 of the paddles 160 and exerts a torque in the direction returning them to their retracted positions. Alternatively, the upper cam 171 may be replaced by a biasing spring which biases the paddles 160 to their retracted positions. With such a structure, if the operating rod 170 is moved upwards, the lower cam 174 will pivot the paddles 160 to their extended positions against the force of the biasing spring, and if the operating rod 170 is moved downwards, the paddles 160 will pivot back to their retracted positions under the force of the biasing spring.

Figure 18:
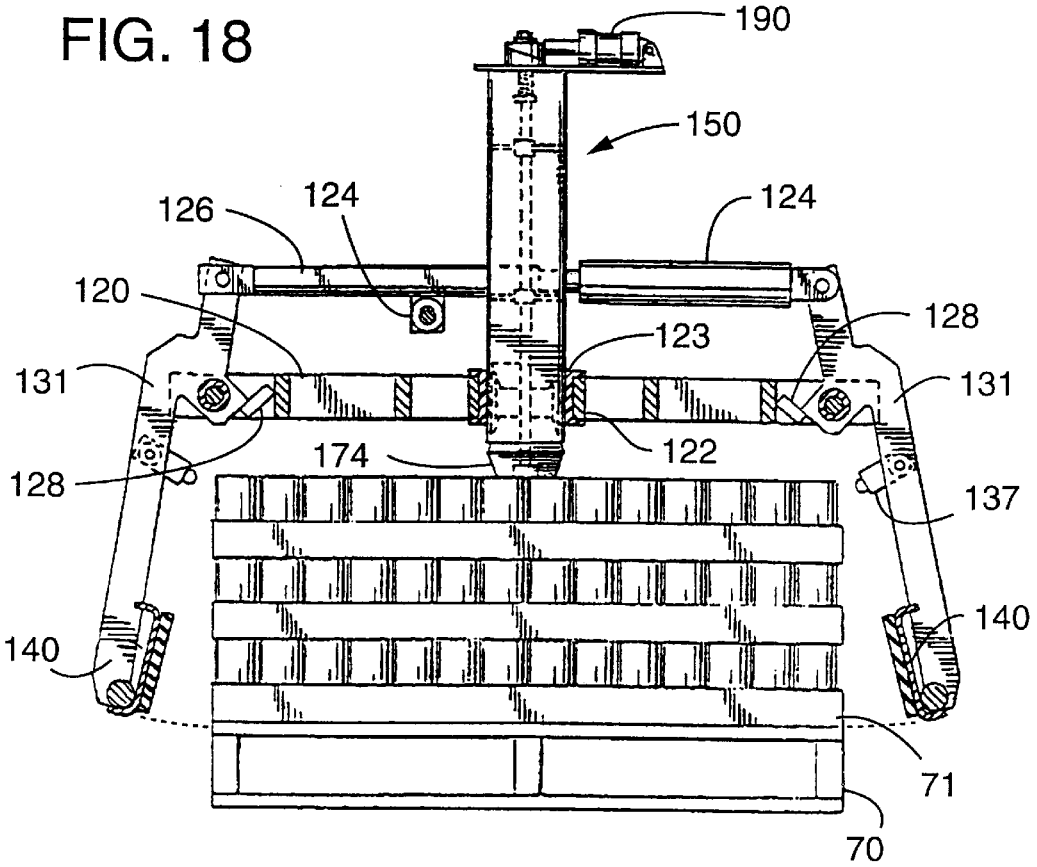
FIG. 18 is a vertical cross-sectional view of the embodiment of FIG. 7 with the internal support in a raised position.

The internal support 150 may be rigidly secured to the frame 120, but preferably the internal support 150 is supported such that it can be raised with respect to the frame 120 when not needed, such as when a layer of objects to be lifted does not have a cavity 72 or when the cavity 72 is smaller than the outer dimensions of the internal support 150. The internal support 150 may be raised and lowered with respect to the frame 120 by a motor or other lifting device, but in the present embodiment, the internal support 150 is slidably supported by the frame 120 so that it can freely move upwards in response to the application of an upwardly directed external force on it, and so that it can slide downwards under its own weight in response to gravity to a lowered position when there is no upwardly directed external force. The path of movement of the internal support 150 in the illustrated embodiment is linear and perpendicular to the plane of the frame 120. The frame 120 includes at its center a subframe 122 defining a square opening large enough to receive the support frame 151 of the internal support 150 and slidably support the support frame 151 for movement between a raised position and a lowered position. Linings 123 of plastic or other suitable material may be mounted on each side of the subframe 122 for slidably guiding the internal support 150 and preventing abrasion of the support frame 151 as it moves up and down in the opening. The upper end of the support frame 151 is equipped with a flat, L-shaped flange 155 having dimensions which are larger than the dimensions of the opening in the subframe 122 so that when the internal support 150 is in its lowered position, the flange 155 rests atop the subframe 122 and transmits the weight of the internal support 150 to the subframe 122. When the clamping portion 100 is lowered onto a layer of objects with no cavity 72 or with a cavity too small to receive the internal support 150, the lower end of the lower cam 174 contacts the top surface of the layer of objects, and an axial force applied by the layer to the internal support 150 through the lower cam 174 causes the internal support 150 to slide upwards with respect to the frame 120 as shown in FIG. 18. With the internal support 150 raised above the layer(s) to be lifted, the clamping arms 130 are operated to grasp the layer(s). At this time, the hydraulic cylinder 190 for operating the paddles 160 may be deactivated if desired so that the paddles 160 will not move in and out as the clamping arms 130 are moved in and out. However, as long as the paddles 160 are not being pressed against any immovable object, the hydraulic cylinder 190 may continue to function in the same manner as when the internal support 150 is in its lowered position. The internal support 150 will remain in its raised position as long as the lower cam 174 is pressed against the top layer of objects to be lifted. When the support frame 151 is raised with respect to the stack, the internal support 150 will slide smoothly downwards until the flange 155 once against rests on the frame 120.

The internal support 150 can be used not only to restrain the inner walls of a cavity 72 but can also or instead be used as a guide for assisting the operator of the clamping apparatus in properly positioning the frame 120 with respect to the objects to be lifted. When the frame 120 is misaligned with respect to a layer of objects having a cavity 72, the internal support 150 will strike on an edge of the cavity 72 and will rise up as shown in FIG. 18 to its raised position to indicate the misalignment to the operator. In contrast, if the frame 120 is properly aligned with respect to a layer having a cavity 72, the internal support 150 can be fully inserted into the cavity 72.

Many different mechanisms other than that used in this embodiment can be employed to raise and lower the operating rod 170. For example, the operating rod 170 can be directly driven by a solenoid, a motor, or a hydraulic cylinder axially connected to the operating rod 170. In addition, many mechanisms other than one using cams 171 and 174 can be used to move the paddles 160 between their retracted and extended positions, such as links, gears, belts, or wires connected between the paddles 160 and a drive member.

Figure 19:
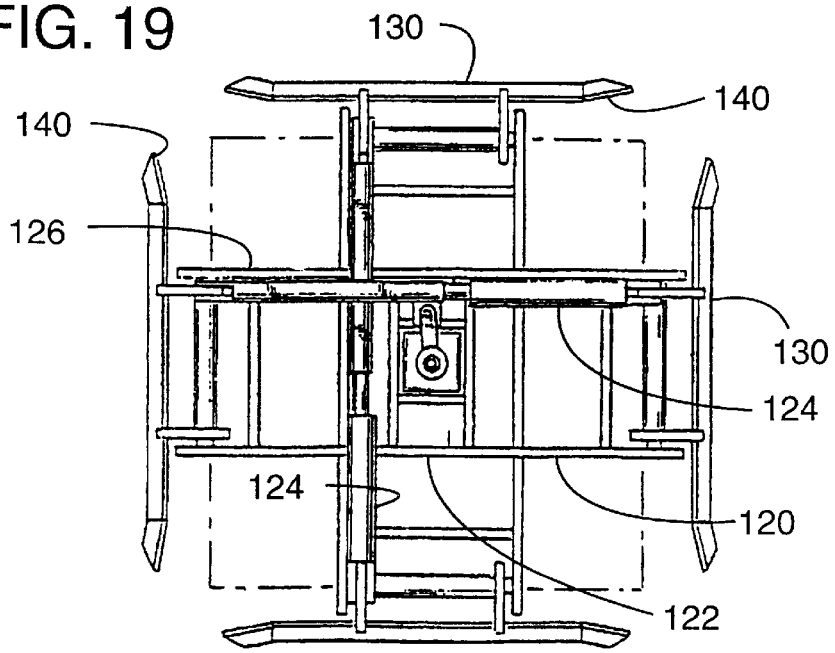

FIGS. 19–21 illustrate a variation of the embodiment of FIGS. 7–18. In this embodiment, the internal support 150 is driven by the hydraulic cylinder 124 for one of the clamping arms 130 instead of by its own hydraulic cylinder 190. As seen in these figures, the drive lever 188 for the second cam 182 is coupled to a bracket 127 mounted on the extension member 126 of one of the hydraulic cylinders 124 in a location which undergoes horizontal movement relative to the frame 120 when the piston rod 125 of the hydraulic cylinder 124 is advanced or retracted. The bracket 127 is situated such that when the clamping arms 130 are in their spread positions shown in FIG. 19 in which they are spaced from the sides of a stack of objects, the lever 188 for the second cam 182 is moved by the bracket 127 to its first position in which the operating rod 170 is in its lowered position and the paddles 160 are in their retracted positions. When the hydraulic cylinders 124 drive the clamping arms 130 to their inwardly pivoted positions shown in FIG. 20 in which they are pressed against the sides of a stack of objects, the lever 188 is moved by the bracket 127 to its second position so that the operating rod 170 is moved upwards to its raised position and the paddles 160 are pivoted to their extended positions in which they reinforce the internal walls of a cavity 72.

The internal support 150 is slidably supported by the frame 120 for vertical movement in the same manner as the internal support 150 of the embodiment of FIGS. 7–18. The lever 188 for operating the paddles 160 is detachably connected to the bracket 127 in a manner such that when the internal support 150 is moved upwards with respect to the frame 120, the lever 188 is automatically disengaged from the bracket 127, and when the internal support 150 returns to its lowered position on the frame 120, the lever 188 is automatically reengaged with the bracket 127. As shown in FIG. 21, which is an elevation of the upper end of the internal support 150, the outer end of the lever 188 is equipped with a downwardly extending pin 189 which can smoothly engage with and disengage from a hole 127*a* formed in the bracket 127.

When the internal support 150 is in its raised position, the movement of hydraulic cylinders 124 has no effect on the internal support 150, since the pin 189 for the lever 188 is disengaged from the bracket 127. Whenever the internal support 150 moves upward or downward with respect to the frame 120, the clamping arms 130 will be in an outwardly pivoted position in which the panels 140 are spaced from the sides of a layer of objects to be lifted. From the time that the lever 188 disengages from the bracket 127 as it moves upward until the time that the lever 188 reengages with the bracket 127, the lever 188 will be in its first position shown by the solid lines in FIG. 16. Therefore, whenever the internal support 150 is moved upwards or downwards with respect to frame 120 between its raised and lowered positions, the hole in the bracket 127 will automatically be aligned with the pin 189 on the lever 188 so that the pin 189 can smoothly engage with and disengage from the bracket 127.

The operation of this embodiment is otherwise the same as that of the preceding embodiment.

FIG. 22 illustrates another embodiment of the present invention employing an internal support 200 with no moving parts. The internal support 200 comprises a block 201 which is slidably supported by the frame 120 for movement with respect to the frame 120 between a raised position and a lowered position. The block 201 is preferably sufficiently small to slide easily into a cavity 72 in a layer of objects to be lifted but large enough to prevent any significant inward movement of the inner walls of the cavity 72 when the layer is being lifted by the clamping arms 130. An example of a suitable size for the block 201 is such that there is a clearance of approximately ¼ inch between the block 201 and the inner walls of the cavity 72 around the entire periphery of the block 201. When the block 201 is in its lowered position shown in FIG. 22, at least a portion of the block 201 is disposed at approximately the same height as the panels 140 of the clamping arms 130 when the clamping arms 130 are pivoted inwards so that the panels 140 are contacting a layer of objects to be lifted. The length of the block 201 in the vertical direction is not critical. An example of a suitable length is the same as the height of the panels 140 on the clamping arms 130. The block 201 is not restricted to a particular shape as long it has surfaces which can reinforce one or more of the inner walls of the cavity 72. In the present embodiment, the block 201 has a periphery similar in shape to the inner periphery of the cavity 72, i.e., a rectangular periphery, with outer dimensions which are somewhat smaller than the inner dimensions of the cavity 72 so that the block 201 can be readily inserted into the cavity 72. The block 201 is connected to a rod 202 which is slidably supported for movement in its axial direction by support plates 203 secured to the subframe 122. Each plate 203 has a hole for receiving the rod 202 and a plastic bushing 204 disposed in the hole for slidably guiding the rod 202. When the block 201 is in its lowered position shown in FIG. 22, its weight is transmitted to the subframe 122 by a collar 205 secured to the rod 202 and resting atop one of the plates 203. When the frame 120 is lowered onto a stack of objects having a cavity 72 large enough to accommodate the block 201, the block 201 moves downwards into the cavity 72 to the level at which the panels 140 of the clamping arms 130 will contact the stack and reinforce the inner walls of the cavity 72 to prevent shifting of the objects adjoining the cavity 72. However, when the frame 120 is lowered onto a stack of objects with no cavity 72 or with a cavity 72 too small to receive the block 201, the lower end of the block 201 contacts the top of the stack and is pushed upwards to allow the clamping arms 130 to move downward to a desired height with respect to the stack to be lifted. Like the internal support 150 of FIGS. 7–18, the block 201 can assist an operator of the clamping apparatus in positioning the frame 120 with respect to layers of objects to be lifted. Thus, if the frame 120 is disposed above a stack of objects with the block 201 off-center with respect to a cavity 72 in the stack, the rod 202 will slide upwards and indicate to the operator that the frame 120 is not properly aligned with respect to the stack of objects. The operation and structure of this embodiment are otherwise the same as for the embodiment of FIGS. 1–5.

Figure 23:
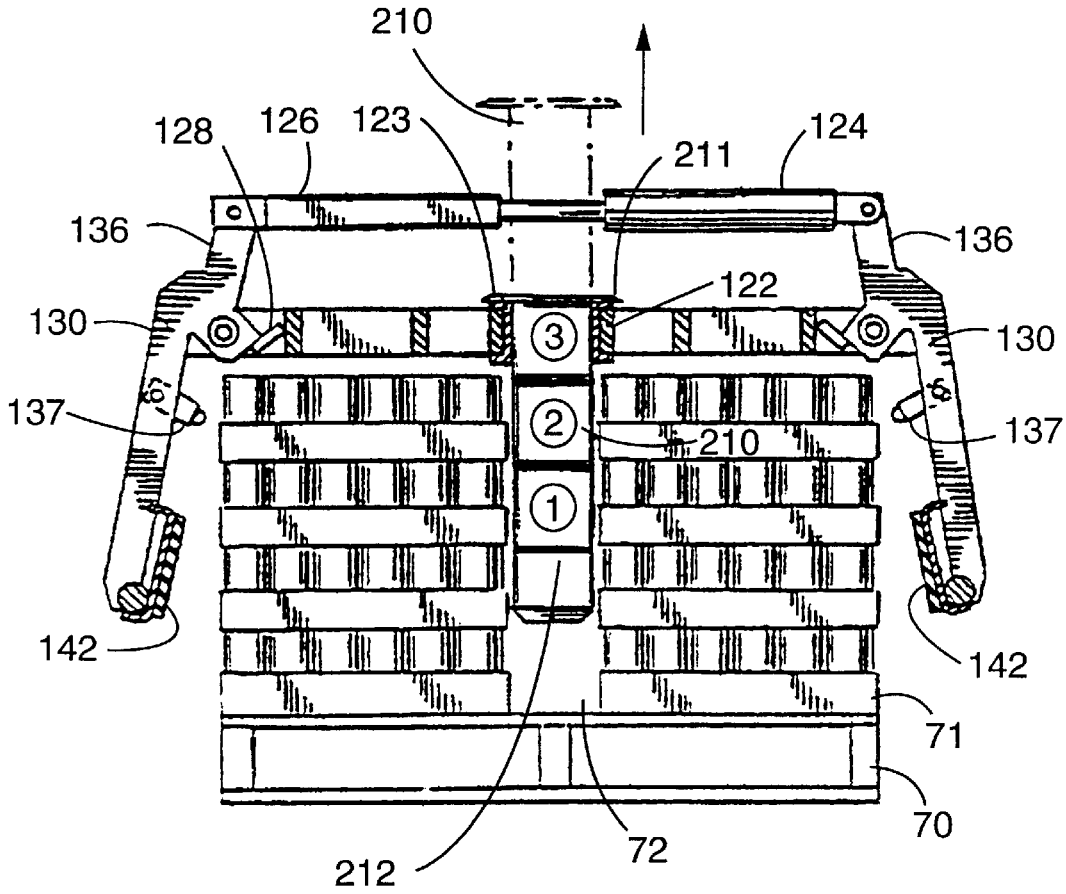
FIGS. 23 and 24 are elevations of additional embodiments of the present invention.

FIG. 23 illustrates another embodiment of the present invention having an internal support 210 comprising an elongated block. The internal support 210 is supported by the frame 120 of the clamping portion for movement between a lowered position shown by solid lines and a raised position shown by dashed lines. The upper end of the internal support 210 is equipped with a flange 211 for supporting the internal support 210 atop a rectangular subframe 122 of the frame 120, while the lower end of the internal support 210 extends to a height corresponding to the height of the panels 140 of the clamping arms 130 when they are pressed against the side of a stack. The lower end of the internal support 210 may be beveled to help guide the internal support 210 into a cavity 72. The internal support 210 may be of any desired structure. For example, it may be a solid block of a suitable material, or it may have a hollow framework which is covered with sheets of a suitable material to give it a smooth outer surface with no projections which could catch on the sides of the cavity 72. An example of a suitable size for the lower end of the internal support 210 is such that there is a clearance of approximately ¼ inch between the internal support 210 and the inner walls of the cavity 72 around the entire periphery of the internal support 210. Like the inner support 200 of FIG. 22, it may have any transverse cross-sectional shape which enables it to reinforce the inner walls of a cavity 72. For example, it may have a cross-sectional shape which is similar to the shape of the cavity 72, or it may have the cross-sectional shape of a circle or other curve surrounded by the cavity 72. The internal support 210 is slidably supported by linings 123 mounted on the inner surface of the subframe 122. When the clamping portion 100 is lowered onto a stack of objects containing a cavity 72 large enough to receive the internal support 210, the internal support 210 can enter the cavity 72 and reinforce the inner walls of the cavity 72. However, when the clamping portion 100 is lowered onto a stack of objects having no cavity or a cavity which is too small to receive the internal support 210 or a cavity which is misaligned with respect to the internal support 210, the lower end of the internal support 210 will contact the top of the stack and be pushed upwards, as shown by the dashed lines in FIG. 23. The operation of this embodiment is otherwise the same as that of the previous embodiment.

An internal support of a clamping apparatus according to the present invention may be affixed with markings to indicate to an operator of the clamping apparatus how far the internal support has been inserted into the cavity in a stack of objects to be lifted. The outer surface of the internal support 210 shown in FIG. 23 is affixed with markings in the form of numbered stripes 212 extending horizontally on the outer surface of the internal support 210. The stripes 212 are located at intervals equal to the height of a layer of objects in the stack. When the internal support 210 is resting on the subframe 122 and is inserted into a cavity 72 in a stack and any one of the stripes 212 is aligned with the upper surface of the stack, the pads 142 of the clamping arms 130 are properly positioned with respect to the sides of the stack to lift the number of layers indicated by the number associated with the stripe 212. For example, when the internal support 210 is resting on the subframe 122 and is inserted into the cavity 72 until stripe number 3 is level with the upper surface of the stack, the pads 142 will be positioned with respect to the stack so as to contact the third layer from the top of the stack, thereby enabling the clamping apparatus to lift the top three layers in the stack. The markings need not be of any particular shape or form. For example, instead of being stripes, the markings can be arrows, regions of a particular color, letters, or various symbols. Similar markings can be provided on the internal support in any of the other embodiments of the present invention.

Figure 24:
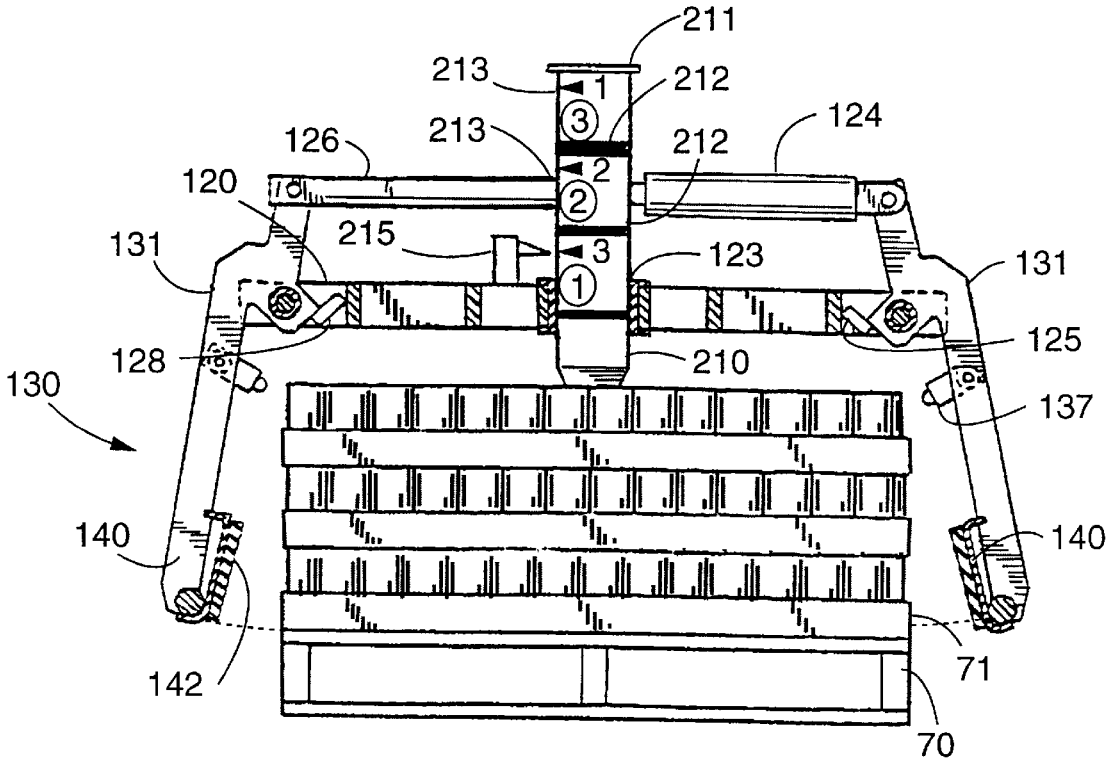

FIG. 24 is a partially cross-sectional elevation showing a variation of the embodiment of FIG. 23 in which the internal support 210 includes additional markings 213 to indicate to the operator of the clamping apparatus the position of the panels 140 of the clamping arms 130 with respect to the layers in the stack when the internal support 210 is resting atop a stack having no cavity. These markings 213 are illustrated as numbered triangles painted on the outer surface of the internal support 210, but the shape of the markings 213 is arbitrary. An indicator 215 is mounted on a portion of the clamping apparatus such as the frame 120 with respect to which the internal support 210 undergoes vertical movement. When the bottom of the internal support 210 is resting on the top layer in the stack and any one of the markings 213 is aligned with the indicator 215, the pads 142 of the clamping arms 130 are properly positioned with respect to the sides of the stack to lift the number of layers indicated by the number associated with the marking 213. For example, when the marking 213 numbered 3 is aligned with the indicator 215 as shown in FIG. 24, the pads 142 will be positioned with respect to the stack so as to contact the third layer from the top of the stack, thereby enabling the clamping apparatus to lift the top three layers in the stack. The structure of this embodiment is otherwise the same as that of the previous embodiment.

In FIG. 24, markings 212 for use when the internal support 210 is inserted into a cavity are separate from markings 213 for use when the internal support 210 rests atop a stack. However, since the spacing between each of markings 212 is the same as the spacing between each of markings 213, the two sets of markings can be combined with each other into a single set.

In the above-described embodiments, an internal support reinforces a cavity 72 around substantially the entire periphery of the cavity 72, but it is possible for the internal support to reinforce less than the entire periphery of a cavity. If the cavity has an irregular shape, for example, the internal support may be used to reinforce one region of the cavity while another region of the cavity is not reinforced. It is also possible for the clamping apparatus to includes more than one internal support. For example, if a layer of objects to be lifted has a plurality of cavities in different locations as viewed from above, the frame 120 may be equipped with a plurality of internal supports for the different cavities. Alternatively, if a cavity in a layer is particularly large or has an irregular shape, a plurality of internal supports can be disposed in a single cavity.

In the embodiments of FIGS. 7–23, the overall structure of the clamping portion 100 is the same as in the embodiments of FIGS. 1–5, but an internal support for reinforcing the sides of a cavity is not restricted to use with a particular type of clamping mechanism. For example, it can be used with various types of conventional clamping mechanisms for lifting barrels, bales, all types of cartons, bottles, bricks, and paper products. Thus, it is useful with any type of clamping mechanism for lifting objects containing a cavity needing reinforcement.

What is claimed is:

1. A clamping apparatus for use in lifting a layer of objects having a cavity, comprising:

a frame;

a pair of clamping arms each having a contact portion for contacting a layer of objects to be lifted and each supported by the frame for movement with respect to the frame between first and second positions, a separation between the contact portions being greater in the first position than in the second position; and an internal support for insertion into a cavity in a layer of objects to be lifted, the internal support being supported by the frame between the clamping arms for linear movement with respect to the frame between a raised and a lowered position.

2. A clamping apparatus as claimed in claim 1 wherein a portion of the internal support is disposed on an imaginary line connecting the contact portions when the internal support is in its lowered position and the clamping arms are in their second position.

3. A clamping apparatus as claimed in claim 1 wherein the frame supports the internal support for movement in a direction perpendicular with respect to a plane of the frame between its raised and lowered positions.

4. A clamping apparatus as claimed in claim 1 wherein the frame supports the internal support for sliding movement such that the internal support can move between its raised and lowered positions under the force of gravity.

5. A clamping apparatus as claimed in claim 1 wherein the internal support includes a support portion and at least one reinforcing member for reinforcing an inner surface of a cavity in a layer to be lifted, each reinforcing member being supported by the support portion for movement with respect to the support portion between a retracted position and an extended position in which a portion of the reinforcing member is farther from the support portion than in the retracted position.

6. A clamping apparatus as claimed in claim 5 wherein each reinforcing member is pivotably supported by the support portion for movement between its retracted and extended positions.

7. A clamping apparatus as claimed in claim 5 including a drive mechanism for moving the clamping arms between their first and second positions while moving each reinforcing member between its retracted and extended positions.

8. A clamping apparatus as claimed in claim 7 wherein the drive mechanism comprises a first actuator operatively connected to one of the clamping arms, a second actuator operatively connected to each reinforcing member, and a controller controlling the operation of the first and second actuators to move each reinforcing member to its extended position when the one of the clamping arms is moved to its second position.

9. A clamping apparatus as claimed in claim 5 comprising an actuator operatively connected to the clamping arms and to each reinforcing member of the internal support.

10. A clamping apparatus as claimed in claim 5 wherein the internal support includes an actuator operatively connected to each reinforcing member for moving each reinforcing member between its retracted and extended positions.

11. A clamping apparatus as claimed in claim 10 wherein the actuator is mounted on the support portion for movement with the support portion between the raised and the lowered position.

12. A clamping apparatus as claimed in claim 5 including an actuator operatively connected to one of the clamping arms for moving the clamping arm between its first and second positions, wherein when the internal support is in its lowered position, the actuator is operatively connected with each reinforcing member to move each reinforcing member between its retracted and extended positions.

13. A clamping apparatus as claimed in claim 12 wherein the internal support disengages from the actuator when the internal support moves from its lowered to its raised position.

14. A clamping apparatus as claimed in claim 1 including a marking on the internal support for indicating a height of the contact portions of the clamping arms with respect to a layer of objects to be lifted.

15. A clamping apparatus as claimed in claim 1 wherein the internal support is disposed above a layer of objects contacted by the contact portions of the clamping arms when in its raised position.

16. A clamping apparatus as claimed in claim 1 wherein the internal support contacts an upper surface of a layer of objects supported by the clamping arms when in its raised position.

17. A clamping apparatus for use in lifting a layer of objects having a cavity, comprising:

a frame;

a pair of clamping arms each having a contact portion for contacting a layer of objects to be lifted and supported by the frame for movement with respect to the frame between first and second positions, a separation between the contact portions being greater in the first position than in the second position; and an internal support for insertion into a cavity in a layer of objects to be lifted, the internal support being mounted on the frame and comprising:

a support portion;

a plurality of reinforcing members pivotably mounted on the support portion for pivoting between a retracted position and an extended position in which a portion of each reinforcing member is farther from the support portion than in the retracted position; and first and second cams supported by the support portion for movement in an axial direction of the support portion between a raised and a lowered position, each of the cams contacting a portion of one of the reinforcing members, the reinforcing members being pivoted by the cams between the retracted and extended positions as the cams move between their raised and lowered positions.

18. A clamping apparatus as claimed in claim 17 wherein the internal support includes an operating rod connected to the first and second cams and supported by the support portion for movement in the axial direction of the support portion.

19. A clamping apparatus as claimed in claim 18 including a drive lever and a motion converting mechanism connected between the drive lever and the operating rod, the motion converting mechanism converting rotation of the drive lever into axial movement of the operating rod.

20. A clamping apparatus as claimed in claim 19 including an actuator drivingly connected to the lever.

21. A clamping apparatus as claimed in claim 20 wherein the actuator is mounted on the internal support.

22. A clamping apparatus as claimed in claim 20 wherein the actuator is drivingly connected to one of the clamping arms for moving the one of the clamping arms between its first and second positions.

23. A clamping apparatus as claimed in claim 17 wherein each reinforcing member has an outer surface for contacting an inner wall of a cavity in a layer of objects to be lifted, the outer surface being substantially flush with an outer surface of the support portion when the reinforcing member is in its retracted position.

24. A clamping apparatus for use in lifting a layer of objects, comprising:

a frame; and a plurality of clamping arms each having a support arm pivotably connected to the frame at a pivot point, a contact portion for contacting a layer of objects to be lifted secured to the support arm, and an adjustable restraint mounted on the support arm in a location between the contact portion and the pivot point for the clamping arm and having an adjustable restraining portion for restraining a portion of a layer of objects above a layer contacted by the contact portion which can be secured against movement with respect to the support arm at a plurality of positions at different distances from the support arm.

25. A clamping apparatus as claimed in claim 24 wherein an angle of the restraint with respect to the support arm can be varied.

26. A method of lifting a layer of objects comprising:

lowering a frame having a pair of clamping arms mounted thereon over a layer of objects;

moving a contact portion of each clamping arm into contact with a side of the layer;

moving an internal support mounted on the frame between the clamping arms upwards with respect to the frame to above the layer; and lifting the frame while grasping the layer with the clamping arms.

27. A method as claimed in claim 26 further comprising:

lowering the frame to lower the layer onto a surface;

moving the clamping arms with respect to the frame to disengage the clamping arms from the layer;

raising the frame with respect to the layer; and lowering the internal support with respect to the frame while raising the frame.

28. A method as claimed in claim 26 including moving the internal support upwards with respect to the frame while lowering the frame over the layer of objects.

29. A method as claimed in claim 26 including contacting the internal support against an upper surface of a layer of objects supported by the clamping arms.

30. A method as claimed in claim 26 including moving the internal support upwards with respect to the frame to above a layer of objects disposed above the layer of objects contacted by the contact portions of the clamping arms.

31. A clamping apparatus for use in lifting a layer of objects having a cavity, comprising:

a frame;

a pair of clamping arms each having a contact portion for contacting a layer of objects to be lifted and each supported by the frame for movement with respect to the frame between first and second positions to vary a separation between the contact portions; and an internal support for insertion into a cavity in a layer of objects to be lifted by the clamping arms, the internal support being mounted on the frame between the clamping arms for upwards movement with respect to the frame from a lowered position to a raised position above a layer contacted by the contact portions of the clamping arms while maintaining a constant orientation with respect to the vertical and while remaining mounted on the frame.

32. A clamping apparatus as claimed in claim 28 wherein the internal support contacts an upper surface of a layer of objects supported by the clamping arms when in its raised position.

33. A clamping apparatus for use in lifting a layer of objects having a cavity, comprising:

a frame;

a pair of clamping arms each having a contact portion for contacting a layer of objects to be lifted and each supported by the frame for movement with respect to the frame between first and second positions to vary a separation between the contact portions; and an internal support for insertion into a cavity in a layer of objects to be lifted, the internal support being mounted on the frame between the clamping arms for translation with respect to the frame in a lengthwise direction of the internal support between a lowered position and a raised position above a layer contacted by the contact portions of the clamping arms while remaining mounted on the frame.

34. A clamping apparatus as claimed in claim 33 wherein the internal support contacts an upper surface of a layer of objects supported by the clamping arms when in its raised position.

35. A clamping apparatus for use in lifting a layer of objects having a cavity, comprising:

a frame;

a pair of clamping arms each having a contact portion for contacting a layer of objects to be lifted and each supported by the frame for movement with respect to the frame between first and second positions to vary a separation between the contact portions; and an internal support for insertion into a cavity in a layer of objects to be lifted, the internal support being mounted on the frame between the clamping arms for upwards movement with respect to the frame from a lowered position to a raised position above a layer contacted by the contact portions of the clamping arms while remaining mounted on the frame when a force in a lengthwise direction of the internal support acts on the internal support.

36. A clamping apparatus as claimed in claim 35 wherein the internal support rests atop a layer of objects supported by the clamping arms when in its raised position.

* * * * *